US011585145B1

(12) United States Patent
Nelson et al.

(10) Patent No.: US 11,585,145 B1
(45) Date of Patent: Feb. 21, 2023

(54) SHIM STACKS AND METHODS

(71) Applicant: Andersen Corporation, Bayport, MN (US)

(72) Inventors: Matthew Nelson, Woodbury, MN (US); Christopher Hanson, Fridley, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 0 days.

(21) Appl. No.: 16/706,979

(22) Filed: Dec. 9, 2019

Related U.S. Application Data

(60) Provisional application No. 62/783,563, filed on Dec. 21, 2018.

(51) Int. Cl.
*E04G 21/10* (2006.01)
*E06B 1/60* (2006.01)

(52) U.S. Cl.
CPC ..... *E06B 1/6069* (2013.01)

(58) Field of Classification Search
CPC .... E06B 1/6069; E04F 21/0007; E04G 21/10; Y10T 428/15
USPC ..... 52/126.1, 217, 745.15
See application file for complete search history.

(56) References Cited

U.S. PATENT DOCUMENTS 2,772,596 A * 12/1956 Trussell ..... B62D 17/00 411/535
4,232,068 A * 11/1980 Hoh ..... E06B 1/6069 428/167
5,491,940 A 2/1996 Bruchu
5,624,724 A * 4/1997 Relly ..... E06B 1/6069 428/167
5,853,838 A 12/1998 Siems et al.
6,159,575 A * 12/2000 Rathsack ..... E06B 1/6069 428/119
6,560,934 B1 * 5/2003 Workman ..... E06B 1/6069 248/188.2
7,520,483 B2 * 4/2009 Rand ..... A47G 7/02 248/346.06
7,716,880 B1 * 5/2010 Shray ..... B29C 44/583 52/126.1
7,784,751 B1 * 8/2010 Bellows ..... A47B 91/00 248/188.2
7,905,465 B1 * 3/2011 Anwar ..... F16M 7/00 248/673
8,739,941 B2 * 6/2014 White ..... B60T 3/00 188/32
8,813,437 B1 8/2014 Spofford
9,855,719 B2 * 1/2018 Gastel ..... B32B 7/06
2002/0054810 A1 * 5/2002 Lemelin ..... B23Q 1/01 411/539
2007/0166498 A1 * 7/2007 Penar ..... E06B 1/6069 428/40.1
2009/0044463 A1 * 2/2009 Moscone ..... E06B 1/6069 52/126.1

(Continued)

*Primary Examiner* — Brian E Glessner
*Assistant Examiner* — James J Buckle, Jr.
(74) *Attorney, Agent, or Firm* — Mueting Raasch Group

(57) ABSTRACT

Angled shim stacks and methods of using the same, which can be used to support to a fenestration unit at those locations where the support is needed by providing a load bearing surface that matches the angle of the fenestration unit sill bottom regardless of the angle of the upper surface of the sill on which the fenestration unit is supported.

21 Claims, 18 Drawing Sheets

(56) References Cited

U.S. PATENT DOCUMENTS

2011/0225925 A1* 9/2011 Sprague ..... E04F 11/1851
52/745.05

* cited by examiner

SHIM STACKS AND METHODS

RELATED APPLICATION

This application claims the benefit under 35 U.S.C. Section 119 of U.S. Provisional Patent Application Ser. No. 62/783,563 entitled "SHIM STACKS AND METHODS" and filed on Dec. 21, 2018, which is incorporated herein by reference in its entirety.

Shim stacks and related methods are described herein.

Fenestration units (such as, e.g., windows, doors, etc.) are typically mounted in frames that include a sill at the bottom of the opening in which the fenestration unit is located. The frame opening is typically slightly larger than the fenestration unit and the position of the fenestration unit is adjusted in the frame opening using shims.

Shimming can be a time-consuming and sometimes frustrating process. In many cases, installers choose to skip shimming to save time which may cause the fenestration unit to be improperly installed because, e.g., the fenestration unit may not be square, level, and/or plumb in the opening.

In particular, proper installation of a fenestration unit having a flat sill bottom installed in an existing opening that has a sloped sill (e.g., a replacement fenestration unit installed in the frame of a previously installed fenestration unit that had a sloped sill, a fenestration unit installed in a masonry opening constructed with a sloped sill, etc.) includes fabrication and installation of a board on the sloped sill such that the upper surface of the sill opening is level. That fabrication typically requires ripping of a board (typically wood) at an angle such that, when installed, the upper surface of the ripped board is level. On-site fabrication of the ripped board is typically required because the angle of the sloped sill may vary and is unknown until the old fenestration unit is removed from the opening.

Proper installation of a fenestration unit having an angled sill bottom installed in an existing opening that has a sloped sill also typically requires fabrication and installation of a ripped board because, in many circumstances, the angle of the angled sill bottom does not match the angle of the sloped sill in an existing opening.

SUMMARY

Shim stacks and methods of using the same are described herein.

The shim stacks and methods described herein may eliminate the need to rip a board or other support member at an angle during installation of a fenestration unit. The shim stacks and methods described herein can be used to provide crucial support to a fenestration unit at those locations where the support is needed by providing a load bearing surface that matches the angle of the fenestration unit sill bottom regardless of the angle of the upper surface of the sill on which the fenestration unit is supported.

In one or more embodiments, the shim stacks include a plurality of shims attached to each other with removal of one or more of the shims changing the angle formed between the top and bottom surfaces of the angled shim stack. As a result, the angle of the shim stack can be adjusted quickly and easily such that placement of the adjusted angled shim stack on an angled sill can result in an upper surface of the angled shim stack matching the angle of the properly installed fenestration unit.

In one or more embodiments, a shim stack may be positioned between the sill and the fenestration unit sill at locations intended to provide proper support for the fenestration unit to, e.g., reduce the likelihood of bending of horizontal members of the fenestration unit due to, e.g., settling or deflection of the building structure, provide an air gap that may allow for the escape of moisture that may find its way beneath the fenestration unit do, for example, to leakage or condensation, etc. In one or more embodiments, shim stacks as described herein may be positioned between the bottom surface of the fenestration unit sill and the sill opening at selected location such as, e.g., vertical side jambs, beneath mull joints of mulled fenestration units, etc.

In a first aspect, one or more embodiments of an angled shim stack as described herein may include: a base shim comprising a leading edge and a trailing edge, wherein the base shim comprises a base depth measured along a base depth axis extending between the leading edge and the trailing edge of the base shim, wherein the base shim comprises a bottom surface and a top surface opposite the bottom surface, wherein both the bottom surface and the top surface extend from the leading edge to the trailing edge of the base shim; and a plurality of shims attached to the base shim, wherein the plurality of shims form a stack of shims positioned on the top surface of the base shim such that the top surface of the base shim is located between the plurality of shims and the bottom surface of the base shim, wherein each shim of the plurality of shims is fixedly attached to at least one adjacent shim and at least one shim is fixedly attached to the base shim. Each shim of the plurality of shims comprises a shim depth measured between a leading shim edge and a trailing shim edge along a shim depth axis aligned with the base depth axis; a bottom shim surface and a top shim surface opposite the bottom shim surface, wherein both the bottom shim surface and the top shim surface extend from the leading shim edge to the trailing shim edge; and wherein a thickness of the at least one shim measured between the top shim surface of the at least one shim and the bottom shim surface of the at least one shim in a direction transverse to the shim depth axis of the at least one shim increases when moving from the leading shim edge of the at least one shim towards the trailing shim edge of the at least one shim.

In one or more embodiments of an angled shim stack as described herein, each shim of the plurality of shims comprises a thickness measured between the top shim surface and the bottom shim surface in a direction transverse to the shim depth axis, wherein the thickness of each shim of the plurality of shims increases when moving from the leading shim edge towards the trailing shim edge.

In one or more embodiments of an angled shim stack as described herein, the leading shim edge of at least one shim of the plurality of shims is set back from the leading edge of the base shim.

In one or more embodiments of an angled shim stack as described herein, the leading shim edge of each shim of the plurality of shims is set back from the leading edge of the base shim.

In one or more embodiments of an angled shim stack as described herein, the trailing shim edge of at least one shim of the plurality of shims is aligned with the trailing edge of the base shim.

In one or more embodiments of an angled shim stack as described herein, the trailing shim edge of at least one shim of the plurality of shims is aligned with the trailing edge of the base shim.

In one or more embodiments of an angled shim stack as described herein, the trailing shim edge of the at least one shim of the plurality of shims is closer to the trailing edge of the base shim than the leading shim edge is to the leading edge of the base shim.

In one or more embodiments of an angled shim stack as described herein, the leading shim edge of the at least one shim of the plurality of shims is aligned with the leading shim edges of the plurality of shims.

In one or more embodiments of an angled shim stack as described herein, each shim of the plurality of shims comprises a leading edge thickness measured between the top shim surface and the bottom shim surface in a direction transverse to the shim depth axis at the leading shim edge and a trailing edge thickness measured between the top shim surface and the bottom shim surface in a direction transverse to the shim depth axis at the trailing shim edge, wherein the trailing edge thicknesses of the plurality of shims are uniform.

In one or more embodiments of an angled shim stack as described herein, each shim of the plurality of shims comprises a wedge shape comprising an increasing thickness as measured between the top shim surface and the bottom shim surface when moving from the leading edge to the trailing edge of each shim of the plurality of shims.

In one or more embodiments of an angled shim stack as described herein, each shim of the plurality of shims comprises a wedge shape defining a selected wedge angle, wherein the selected wedge angle is defined by an increasing thickness as measured between the top shim surface and the bottom shim surface when moving from the leading edge to the trailing edge of each shim of the plurality of shims. In one or more embodiments, the selected wedge angle of each shim of the plurality of shims is the same. In one or more embodiments, the selected wedge angle of all shims of the angled shim stack is the same. In one or more embodiments, the selected wedge angle of two or more shims of the plurality of shims are different. In one or more embodiments, the plurality of shims comprises shims of two or more colors.

In one or more embodiments of an angled shim stack as described herein, the plurality of shims comprises shims of two colors, wherein the shims of different colors alternate when moving through the plurality of shims in a direction away from the base shim.

In one or more embodiments of an angled shim stack as described herein, the plurality of shims comprises shims of two or more colors, wherein each shim of the plurality of shims comprises a wedge shape defining a selected wedge angle, wherein the selected wedge angle is defined by an increasing thickness as measured between the top shim surface and the bottom shim surface when moving from the leading edge to the trailing edge of each shim of the plurality of shims, and wherein shims of the same color comprise wedge shapes comprising the same selected wedge angle.

In one or more embodiments of an angled shim stack as described herein, a thickness of the base shim measured between the top surface and the bottom surface in a direction transverse to the base depth axis increases when moving from the leading edge of the base shim towards the trailing edge of the base shim. In one or more embodiments, the base shim comprises a base shim wedge shape comprising an increasing thickness as measured between the top shim surface and the bottom shim surface when moving from the leading edge of the base shim to the trailing edge of the base shim. In one or more embodiments, the at least one shim of the plurality of shims comprises a wedge shape defining a selected wedge angle, wherein the selected wedge angle is defined by the increasing thickness as measured between the top shim surface and the bottom shim surface of the at least one shim when moving from the leading edge of the at least one shim to the trailing edge of the at least one shim, and wherein the base shim comprises a base shim wedge shape defining a base shim wedge angle, wherein the selected wedge angle of the at least one shim is the same as the base shim wedge angle.

In one or more embodiments of an angled shim stack as described herein, each shim of the plurality of shims comprises a fastener opening extending through the top and bottom shim surfaces, and wherein the fastener openings in the plurality of shims are aligned such that the fastener openings form a composite fastener opening extending through the stack of shims.

In one or more embodiments of an angled shim stack including a fastener opening in each shim as described herein, the base shim comprises a fastener opening extending through the top and bottom surfaces of the base shim, and wherein the fastener opening in the base shim is aligned with the composite fastener opening extending through the stack of shims.

In one or more embodiments of an angled shim stack including a fastener opening in each shim as described herein, each fastener opening in the plurality of shims is positioned in a dimple formed in the shim, wherein the dimple comprises a depression in the top shim surface and a corresponding protrusion extending from the bottom shim surface, and wherein, for adjacent pairs of shims of the plurality of shims, the protrusion extending from the bottom shim surface extends into the depression in the top shim surface facing the bottom shim surface. In one or more embodiments, the base shim comprises a base shim depression extending to the top surface of the base shim, wherein the protrusion extending from the bottom shim surface of the shim positioned on the top surface of the base shim extends into the base shim depression.

In one or more embodiments of an angled shim stack as described herein, each pair of adjacent shims fixedly attached to each other are attached by a mechanical connection. In one or more embodiments, the mechanical connection comprises a friction fit between complementary structures on the pair of adjacent shims. In one or more embodiments, the mechanical connection comprises mating interlocking structures on the pair of adjacent shims.

In one or more embodiments of an angled shim stack as described herein, at least one shim of the plurality of shims comprises a frame interlock structure configured to interlock with a complementary shim interlock structure on a fenestration frame member. In one or more embodiments, each shim of the plurality of shims comprises a frame interlock structure configured to interlock with a complementary shim interlock structure on a fenestration frame member, and wherein the frame interlock structures on each pair of adjacent shims of the plurality of shims interlock to fixedly attach the pair of adjacent shims to each other. In one or more embodiments, only one shim of the plurality of shims comprises the frame interlock structure.

In a second aspect, one or embodiments of a method of adjusting a wedge angle of an angled shim stack as described herein includes: determining an angle defined between a frame member of a fenestration unit and a surface of an opening facing the frame member; and detaching at least one shim from a plurality of shims of an angled shim stack to adjust a wedge angle formed by the angled shim stack, wherein the wedge angle substantially matches the angle defined between the frame member and the surface of the opening facing the frame member. The angled shim stack used in the method comprises: a base shim comprising a leading edge and a trailing edge, wherein the base shim comprises a base depth measured along a base depth axis extending between the leading edge and the trailing edge of the base shim; wherein each shim of the plurality of shims is fixedly attached to at least one adjacent shim and at least one shim is fixedly attached to the base shim such that the plurality of shims are fixedly attached to the base shim, and wherein each shim of the plurality of shims comprises: a bottom shim surface and a top shim surface opposite the bottom shim surface, wherein both the bottom shim surface and the top shim surface extend from a leading shim edge to a trailing shim edge; wherein at least one shim of the plurality of shims comprises a thickness measured between the top shim surface and the bottom shim surface in a direction transverse to the shim depth axis, and wherein the thickness of the at least one shim increases when moving from the leading shim edge of the at least one shim towards the trailing shim edge of the at least one shim.

In one or more embodiments of the method of adjusting a wedge angle of an angled shim stack as described herein, at least one shim of the plurality of shims comprises a shim depth measured between the leading shim edge and the trailing shim edge along a shim depth axis aligned with the base depth axis, wherein the shim depth is less than the base depth. In one or more embodiments, the leading shim edge of the at least one shim is set back from the leading edge of the base shim.

In one or more embodiments of the method of adjusting a wedge angle of an angled shim stack as described herein, the trailing shim edge of each shim of the plurality of shims is aligned with the trailing edge of the base shim.

In one or more embodiments of the method of adjusting a wedge angle of an angled shim stack as described herein, the trailing shim edge of each shim of the plurality of shims is closer to the trailing edge of the base shim than the leading shim edge is to the leading edge of the base shim.

In one or more embodiments of the method of adjusting a wedge angle of an angled shim stack as described herein, each shim of the plurality of shims comprises a wedge shape comprising an increasing thickness as measured between the top shim surface and the bottom shim surface when moving from the leading edge to the trailing edge of each shim of the plurality of shims.

In one or more embodiments of the method of adjusting a wedge angle of an angled shim stack as described herein, each shim of the plurality of shims comprises a wedge shape defining a selected wedge angle, wherein the selected wedge angle is defined by an increasing thickness as measured between the top shim surface and the bottom shim surface when moving from the leading edge to the trailing edge of each shim of the plurality of shims, and wherein removal of any shim of the plurality of shims changes the wedge angle formed by the angled shim stack. In one or more embodiments, the selected wedge angle of each shim of the plurality of shims is the same, and wherein removal of any shim of the plurality of shims changes the wedge angle formed by the angled shim stack by the same amount. In one or more embodiments, the selected wedge angle of all shims of the angled shim stack is the same, wherein removal of any shim of the angled shim stack changes the wedge angle formed by the angled shim stack by the same amount. In one or more embodiments, the selected wedge angle of two or more shims of the plurality of shims are different, and wherein removal of a selected shim of the plurality of shims changes the wedge angle formed by the angled shim stack by the selected wedge angle of the removed shim.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Where used herein, the terms "top" and "bottom" are used for reference relative to each other when the angled shim stacks are installed in a building opening between a fenestration unit and a building opening.

Where used herein, the terms "exterior" and "interior" are used in a relative sense, e.g., an exterior edge and an interior edge of a sill or any other component describe edges located on opposite sides of the fenestration unit. In other words, an exterior edge could be found within the interior of a building or other structure that would conventionally define an interior and an exterior, while an interior edge could be found outside of a building or other structure that would conventionally define an interior and an exterior.

The above summary is not intended to describe each embodiment or every implementation of the angled shim stacks and methods described herein. Rather, a more complete understanding of the invention will become apparent and appreciated by reference to the following Description of Illustrative Embodiments and claims in view of the accompanying figures of the drawing.

Figure 1:
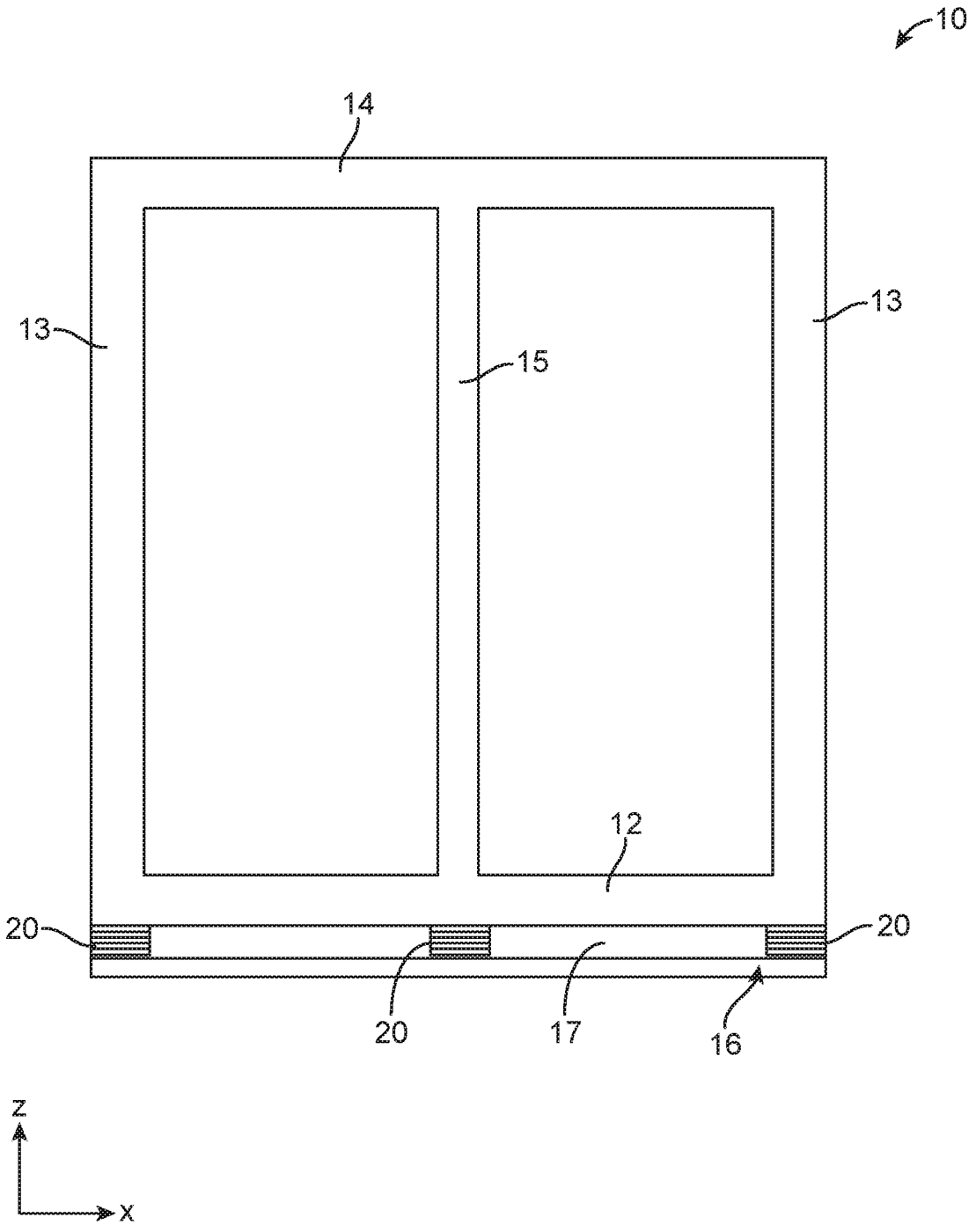
FIG. 1 depicts one illustrative embodiment of a fenestration unit supported on an angled sill by a set of shim stacks as described herein.

The axes of a Cartesian coordinate system are depicted in the figures to assist the viewer in understanding the various components and views of the drawing. The axes are for relationship purposes only and no particular orientation for any of the axes is implied (e.g., the Z-axis may or may not be aligned with the direction of gravitational force).

DESCRIPTION OF ILLUSTRATIVE EMBODIMENTS

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

One illustrative embodiment of a fenestration unit is depicted in FIG. 1, with the fenestration unit 10 being positioned on a sill 16 of an opening, the sill 16 having a sloped or angled support surface 17. The fenestration unit 10 includes a frame that is formed by a fenestration sill 12, side jambs 13, and head jamb 14. The illustrative embodiment of fenestration unit 10 also includes a mull post 15 extending between the fenestration unit sill 12 and the head jamb 14. The fenestration unit sill 12 is supported on the support surface 17 of the opening sill 16 by a set of angled shim stacks 20.

The fenestration units used with the shim stacks described herein may, in one or more embodiments, include one or more panels in a frame, such as, e.g., glazing units, window sashes, door panels, etc. in one or more embodiments, one or more of the panels may be mounted for movement relative to the frame members of the fenestration unit such that the one or more panels can be moved to close or open at least a portion of the fenestration unit to, e.g., allow traffic and/or air to pass through the fenestration unit. In one or more embodiments, one or more of the panels (e.g., a glazing unit, etc.) may be fixed in position relative to the frame members of the fenestration unit. In one or more embodiments, the movable panels may be mounted for sliding movement, rotational movement, and/or combinations thereof relative the frame members of the fenestration unit.

Although the frame members of the depicted illustrative embodiment of fenestration unit 10 form a rectangular fenestration unit, fenestration units as described herein may take a variety of shapes.

Figure 2:
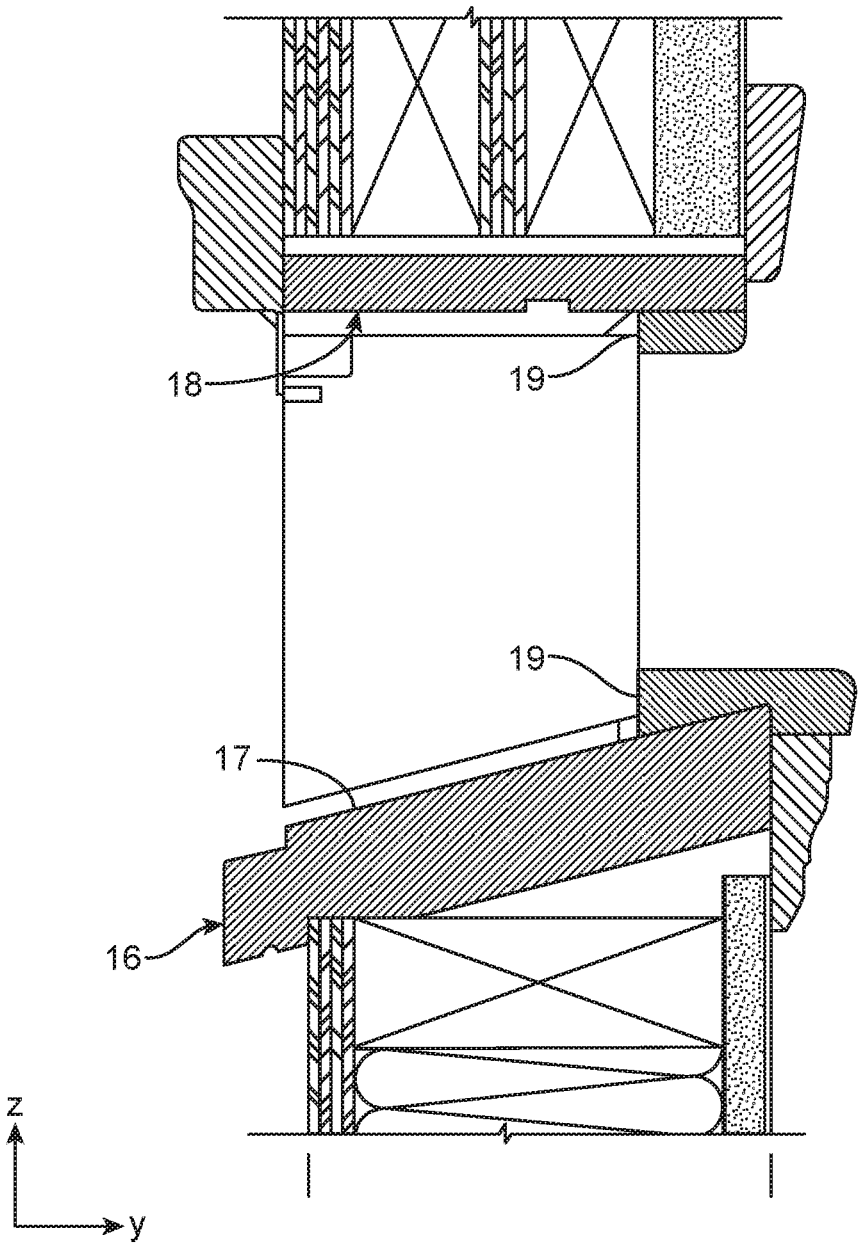
FIG. 2 is a cross-sectional diagram of an opening in a wall including an angled sill on which a fenestration unit may be installed.

FIG. 2 is a cross-sectional view of the opening sill 16 of FIG. 1 taken in a plane oriented transverse to the length of the sill 16 as it extends between the side jambs 13 of the replacement fenestration unit 10 (with the fenestration unit 10 removed). The opening sill 16 is, in this illustrative embodiment, the sill of a fenestration unit that has been removed to prepare the opening for an insert replacement fenestration unit. As a result, the sill 16 and the head jamb 18 remain in place in the opening. Because the insert replacement fenestration unit is to be inserted from the exterior side of the wall (i.e., from the left side of FIG. 2) the stops 19 on the interior side are left in place so that the replacement fenestration unit can be inserted into the opening and advanced towards the interior side of the wall until the replacement fenestration unit abuts the stops 19.

The cross-sectional view of FIG. 2 depicts only one type of opening that may receive a fenestration unit. Further, although the angled shim stacks described herein may be well-suited for use with replacement fenestration units, the angled shim stacks described herein may be used in any suitable application where shimming is required between two surfaces that are not aligned (e.g., substantially parallel) with each other.

One illustrative embodiment of an angled shim stack as described herein is FIGS. 3, 4, 5A, and 5B. The angled shim stack 20 includes a base shim 30 and a plurality of shims 40 forming a stack of shims 22 positioned on the upper surface 35 of the base shim 30.

The base shim 30 includes a leading edge 32 and a trailing edge 34, with the base shim 30 having a base depth measured along a base depth axis 31 that extends between the leading edge 32 and trailing edge 34 of the base shim 30. In the depicted embodiment, the base depth axis 31 is aligned with the Y-axis of the Cartesian coordinate system used in the figures. The base shim 30 also includes a top surface 35 that extends from the leading edge 32 to the trailing edge 34 of the base shim 30. The base shim 30 further includes a bottom surface 37 (see, e.g., FIGS. 5A & 5B) that also extends from the leading edge 32 to the trailing edge 34 of the base shim 30.

Although not required in the angled shim stacks described herein, the depicted illustrative embodiment of base shim 30 has a thickness measured between the top surface 35 and the bottom surface 37 in a direction transverse to the base depth axis 31 increases when moving from the leading edge 32 towards the trailing edge 34 of the base shim 30. In one or more embodiments, the increase in thickness may be uniform over the base depth of the base shim 30 such that the base shim 30 forms a wedge shape having a selected base shim wedge angle defined by the changing thickness of the base shim 30 as measured between the top surface 35 and bottom surface 37 of the base shim 30 when moving from the leading edge 32 towards the trailing edge 34. In one or more embodiments, the base shim wedge angle may be, on the lower end of the range, greater than 0°, 0.5° or more, 1° or more, 2° or more, etc. In one or more embodiments, the base shim wedge angle may be, on the upper end of the range, 4° or less, 3° or less, 2° or less, 1° or less, etc.

As noted above, a wedge shaped base shim is optional in the angled shim stacks described herein, and, in one or more embodiments, the base shims used in angled shim stacks described herein may have a uniform thickness as measured between their top and bottom surfaces.

The angled shim stack 20 depicted in FIGS. 3, 4, 5A, and 5B includes a stack of shims 22 positioned on the top surface 35 of the base shim 30. Each of the shims 40 includes a leading shim edge 42 and a trailing shim edge 44, with a shim depth measured between the leading shim edge 42 and the trailing shim edge 44 along a shim depth axis that extends between the leading shim edge 42 and the trailing shim edge 44, with the shim depth axis being generally aligned with the base depth axis 31.

Each of the shims 40 includes a top shim surface 45 and a bottom shim surface 49 (see, e.g., FIG. 5B), with the top shim surface 45 and the bottom shim surface 49 being located on opposite sides of the shim 40. Both the top shim surface 45 and the bottom shim surface 49 extend from the leading shim edge 42 to the trailing shim edge 44 for each of the shims 40.

Each of the shims 40 have a thickness measured between the top shim surface 45 and the bottom shim surface 49 in a direction transverse to the shim depth axis which in the depicted illustrative embodiments is generally along the Z-axis and/or generally transverse to both the X-axis and the Y-axis of the Cartesian coordinate system depicted in the figures.

In one or more embodiments of the angled shim stacks described herein, the thickness of each of the shims increases when moving from the leading shim edge 42 towards the trailing shim edge 44. In one or more embodiments, the increase in thickness may be uniform over the shim depth of the shim 40 such that the shim 40 forms a wedge shape having a selected wedge angle defined by the changing thickness of the shim 40 as measured between its top surface 45 and its bottom surface 49 when moving from the leading shim edge 42 to the trailing shim edge 44. In one or more embodiments the wedge angle of each shim may be, on the lower end of the range, greater than 0°, 0.5° or more, 1° or more, 2° or more, etc. In one or more embodiments, the wedge angle of each shim may be, on the upper end of the range, 4° or less, 3° or less, 2° or less, 1° or less, etc. In one or more embodiments, the base shims used in the shim stacks described herein may have a larger wedge angle than the shims attached to the base shim.

Figure 4:
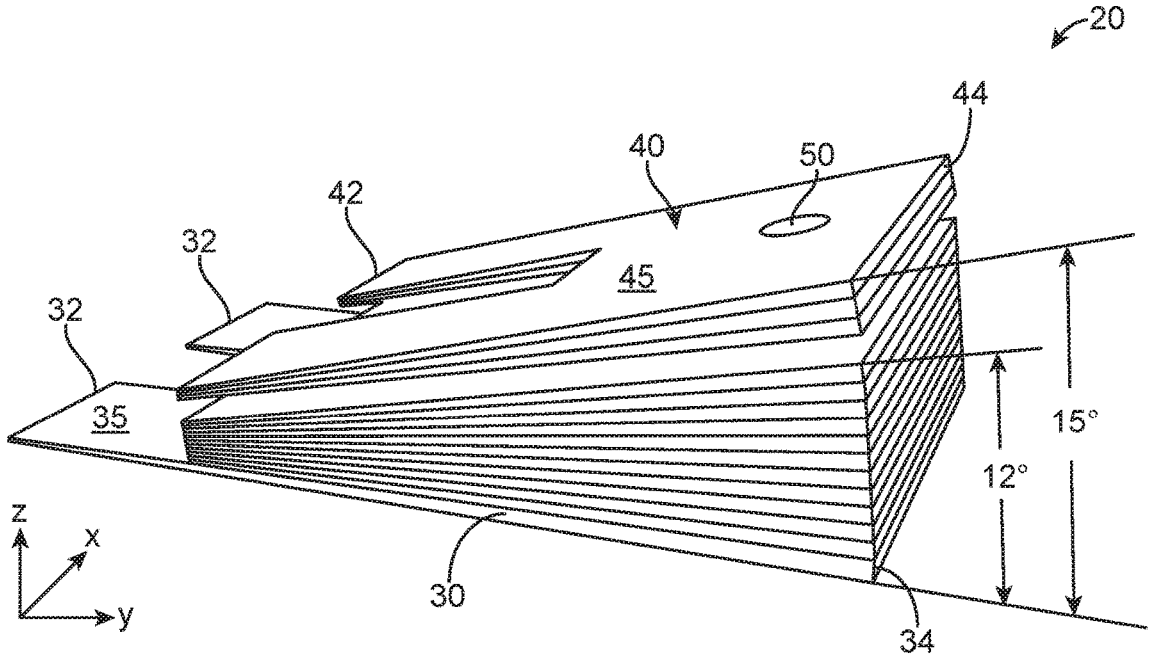
FIG. 4 is a perspective view of the angled shim stack of FIG. 3 with a group of shims separated from the shim stack.

With reference to FIG. 4, the depicted illustrative embodiment of angled shim stack 20 includes a base shim 30 having a base shim wedge angle of 1° and a stack of shims 40 each of which has a wedge angle of 1°. As a result, positioning fourteen shims 40 on the base shim 30 provides an angled shim stack 20 having a wedge angle of 15°. Removal of three shims 40 from the stack of shims 40 would result in an angled shim stack 20 having a wedge angle of 12°.

In one or more embodiments, the shim depth of shims 40 is less than the base depth of the base shim as measured from the base shim leading edge 32 to the base shim trailing edge 44.

Further, in one or more embodiments of the angled shim stacks described herein, the leading shim edges 42 may be set back from the leading edge 32 of the base shim 30 by a setback distance 24.

In one or more embodiments of the angled shim stacks as described herein the trailing shim edges 44 of the stack of shims 22 are aligned with the trailing edge 34 of the base shim 30, where the aligned trailing edges 34 and 44 form an arcuate surface due to the angled wedge shapes of the components in the angled shim stack.

In one or more embodiments, the trailing shim edge 44 of each shim 40 of the stack of shims 22 is closer to the trailing edge 34 of the base shim 30 than the leading shim edge 42 is to the leading edge 32 of the base shim 30. In other words, the distance between the trailing edges 44 of the stack of shims 22 as measured along the top surface 35 of the base shim 30 is less than the distance between the leading edges 42 of the stack of shims 22 as measured along the top surface 35 of the base shim 30.

Figure 3:
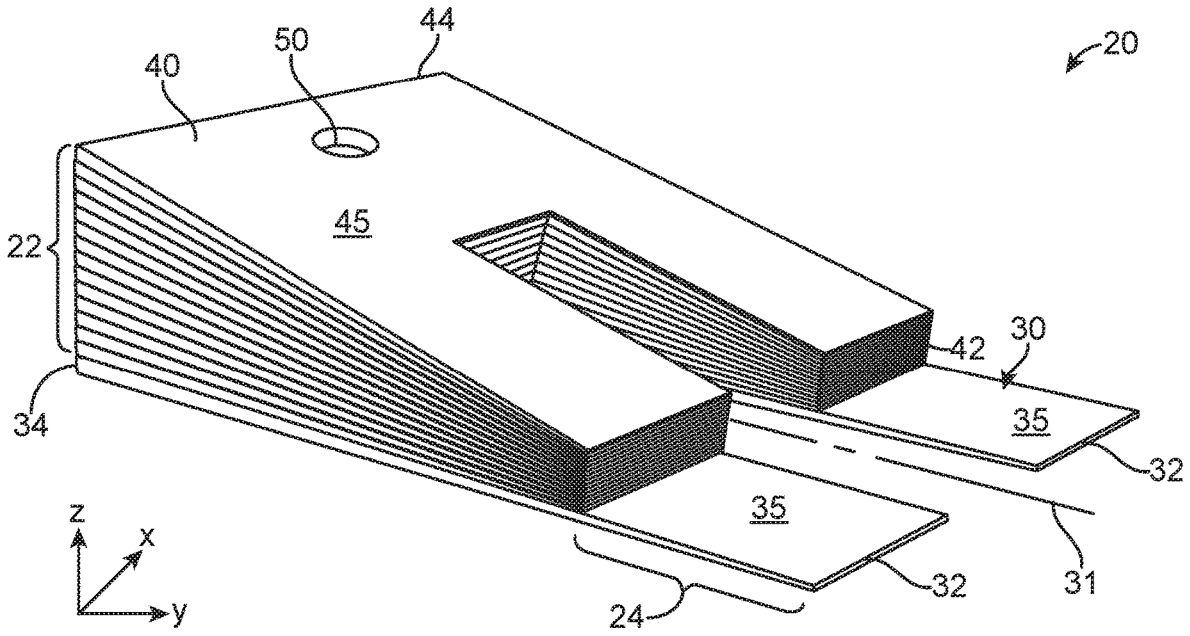
FIG. 3 is a perspective view of one illustrative embodiment of an angled shim stack as described herein.
Figure 5A:
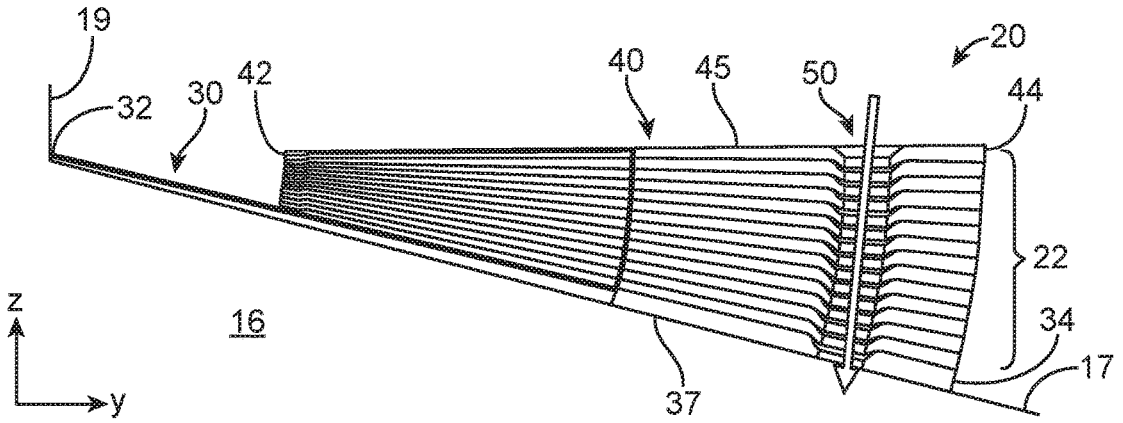
FIG. 5A is a cross-sectional view of the angled shim stack of FIGS. 3-4 on a sill with an angled sill surface, wherein the cross-sectional view is taken through a composite fastener opening formed by the shims of the shim stack and the base shim.

In one or more embodiments, the leading shim edges 32 of the stack of shims 22 may be aligned with each other as seen in, e.g., FIGS. 3, 4, & 5A.

In one or more embodiments, each shim 40 of the stack of shims 22 may be described as having a leading edge thickness measured between the top shim surface 45 and the bottom shim surface 49 along the leading edge 42 of each shim 40, as well as a trailing edge thickness measured between the top shim surface 45 and the bottom shim surface 49 along the trailing edge 44 of each shim 40. In one or more embodiments, the trailing edge thicknesses of each shim 40 in the stack of shims 22 is uniform, i.e., all of the shims 40 in the stack of shims 22 have the same trailing edge thickness.

In one or more embodiments, each shim of the plurality of shims 40 in the stack of shims 22 may be described as having a wedge shape defining a selected wedge angle that is defined by the top shim surface 45 and the bottom shim surface 49. In one or more embodiments, the wedge angle of each shim of the plurality of shims 40 in the stack of shims 22 is the same. In other words, each shim 40 of the stack of shims 22 may define a selected wedge angle that is, e.g., 1°.

In one or more alternative embodiments, the stack of shims 22 may include two or more shims 40 that have different wedge angles. For example, in one or more embodiments, one or more shims may have a wedge angle of, e.g. 1°, while one or more other shims 40 in the stack of shims 22 may have a wedge angle of 0.5°, 2°, 3°, 4°, etc.

In one or more embodiments, the shims 40 in the stack of shims 22 may be provided in two or more colors. In one or more embodiments, the two or more colors may be alternated when moving through the stack of shims 22 towards the base shim 30. For example, in one or more embodiments, a lighter colored shim may be alternated with darker colored shims, etc. In embodiments including shims having different wedge angles as described herein, shims 40 of the same color may have a wedge shape having the same wedge angle. For example, all lighter colored shims may have a wedge angle of 1°, while all darker colored shims may have a different wedge angle of 0.5°, 2°, etc.

In one or more embodiments, providing shims 40 and two or more different colors may facilitate adjustment of the wedge angle formed by the angled shim stack by providing a visual indicator to a user when removing one or more shims from the stack of shims 22 or adding one or more shims to the stack of shims 22 to adjust the wedge angle formed by the angled shim stack 20.

Referring to FIG. 4, the angled shim stack 20 may define a wedge angle between the bottom surface 37 of the base shim 30 and the top surface 45 of the uppermost shim 40 in the stack of shims 22. Changing the number of shims 40 in the stack of shims 22 can be used to adjust that wedge angle as needed during installation of a fenestration unit or any other shimming task. FIG. 4 depicts removal of three shims 40 from the stack of shims 22 to adjust the wedge angle formed by the angled shim stack 20 from 15° to 12° (because each of the removed shims 40 has its own wedge angle of 1° in this illustrative embodiment).

Each shim 40 in the stack of shims 22 is fixedly attached to at least one adjacent shim 40 and at least one shim 40 is fixedly attached to the base shim 30 such that the stack of shims 22 and the base shim 30 form a connected angled shim stack. Attachment of the shims 40 in the stack of shims 22 to each other and, optionally, to the base shim 30 may be accomplished using any suitable technique or combination of techniques. For example, in one or more embodiments, the shims may be attached to each other using adhesives, mechanical fasteners, clips, interference fits, etc. In embodiments where, for example, if the shims are constructed out of thermoplastic materials, the shims may be heat staked or otherwise welded (ultrasonically, thermally, chemically, etc.) to each other in a manner that retains connections between the shims 40 when desired, but that allows for easy and preferably complete removal of the shims to allow for adjustment of the wedge angle of the angled shim stack 20. As used herein, the term "fixedly attached" (and variations thereof) means that the two components (e.g., two shims) remain attached to each other until physically separated regardless of the orientation of the shim stack, where physical separation may involve, e.g., removing a fastener connecting the components, breaking or severing a bond between the components (e.g., an adhesive bond and/or welded joint), separating a mechanically interlocking structure (e.g., connections such as puzzle pieces), snap-fit connections, friction-fit connections (e.g., using posts and receiving structures such as, e.g., LEGO blocks), etc.

Although the illustrative embodiment of the angled shim stack 20 includes a slot formed in the base shim 30 as well as the shims 40 of the stack of shims 22, with the slot extending from the leading edges 32/42 towards the trailing edges 34/44, any such slot is optional and may or may not be provided in an angled shim stack as described herein. Such a slot may, in one or more embodiments, provide clearance for components that may protrude from a fenestration unit.

Figure 5B:
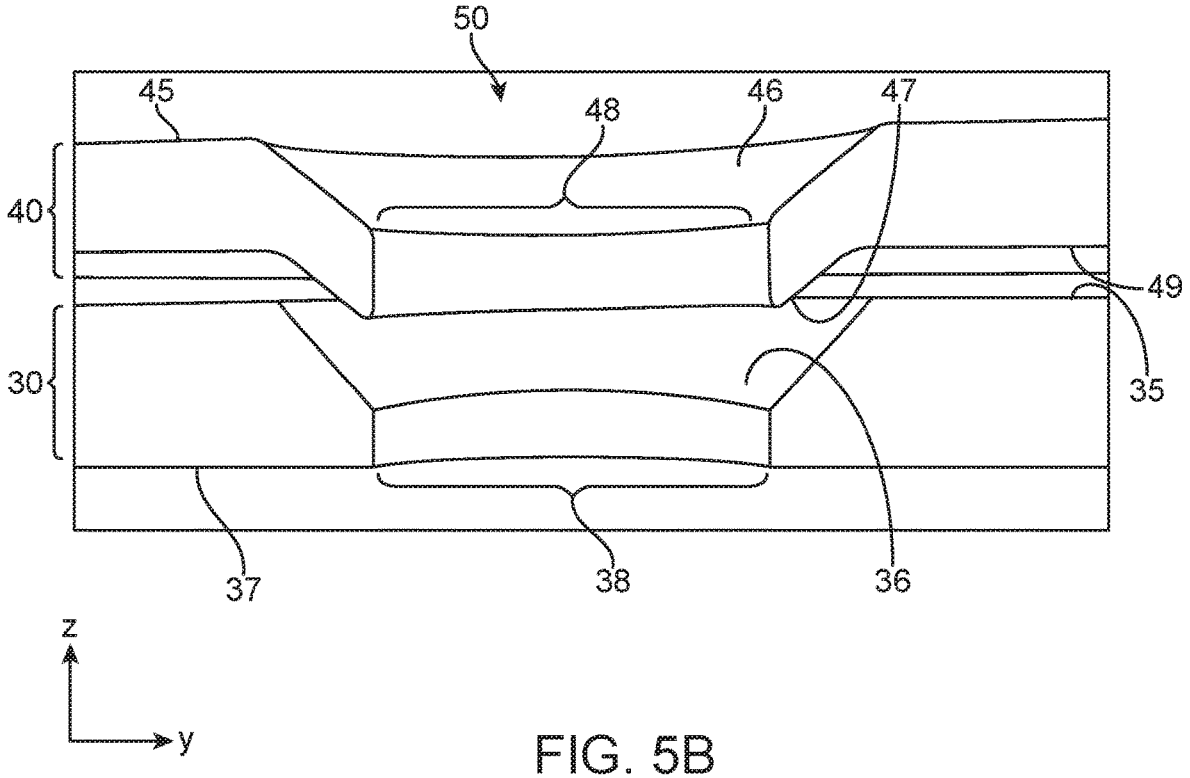
FIG. 5B is an enlarged cross-sectional view of two illustrative fastener openings in a shim and the base shim of the angled shim stack of FIG. 5A.

In optional feature that may be provided in one or more embodiments of an angled shim stack as described herein includes a fastener opening that extends through the stack of shims to allow for fastening of the angled shim stack during use. With reference to FIGS. 5A and 5B, each shim 40 of the stack of shims 22 may, in one or more embodiments, include a fastener opening 48 extending through the top surface 45 and the bottom surface 47 of the shim 40.

In one or more embodiments, the fastener openings in the shims 40 of the stack of shims 22 may be aligned such that the fastener openings 48 form a composite fastener opening 50 extending through the stack of shims 22.

In one or more embodiments, the base shim 30 may also include a fastener opening 38 formed through the base shim from its top surface 35 to its bottom surface 37. The fastener opening 38 may also be aligned with the fastener openings 48 of the shims 40 and, as a result the composite fastener opening 50 extending through the stack of shims 22.

In one or more embodiments, the fastener openings 48 in the shims 40 may be positioned in a dimple formed in the shim 40, with the dimple including a depression 46 in the top shim surface 45 and a corresponding protrusion 47 extending from the bottom shim surface 49. In one or more embodiments, the protrusion 47 extending from the bottom shim surface 49 extends into the depression 46 in the top shim surface 45 that faces the bottom shim surface 49 for adjacent pairs of shims 40 of the stack of shims 22. In one or more embodiments that nesting arrangement between the dimples in the shims 40 may facilitate accurate positioning of the shims 40 relative to each other during, e.g., manufacturing and/or use. In particular, if one or more shims 40 are removed from a stack of shims 22 and subsequently one or more of the removed shims is needed, the nesting arrangement provided by the dimples may facilitate accurate repositioning of the shims.

Although the nested dimples provided in connection with the fastener openings of this illustrative embodiment provide one mechanism for alignment of shims 40 in a stack of shims 22 of an angled shim stack as described herein, many other structures may serve a similar purpose such as, e.g., complementary posts and voids in adjacent shims, nesting of complementary shapes (e.g., lips on the shim edges, etc.), mechanically interlocking structures (e.g., connections such as puzzle pieces), snap-fit connections, friction-fit connections (e.g., using posts and receiving structures such as, e.g., LEGO blocks), etc.

As discussed herein, the angled shim stacks described herein may, in one or more embodiments, be used to facilitate installation of fenestration units on sills having an angled or sloped surface that does not match the angle of the bottom surface of a sill of the fenestration unit. FIGS. 6-12 depict a variety of installations using angled shim stacks as described herein.

Figure 6:
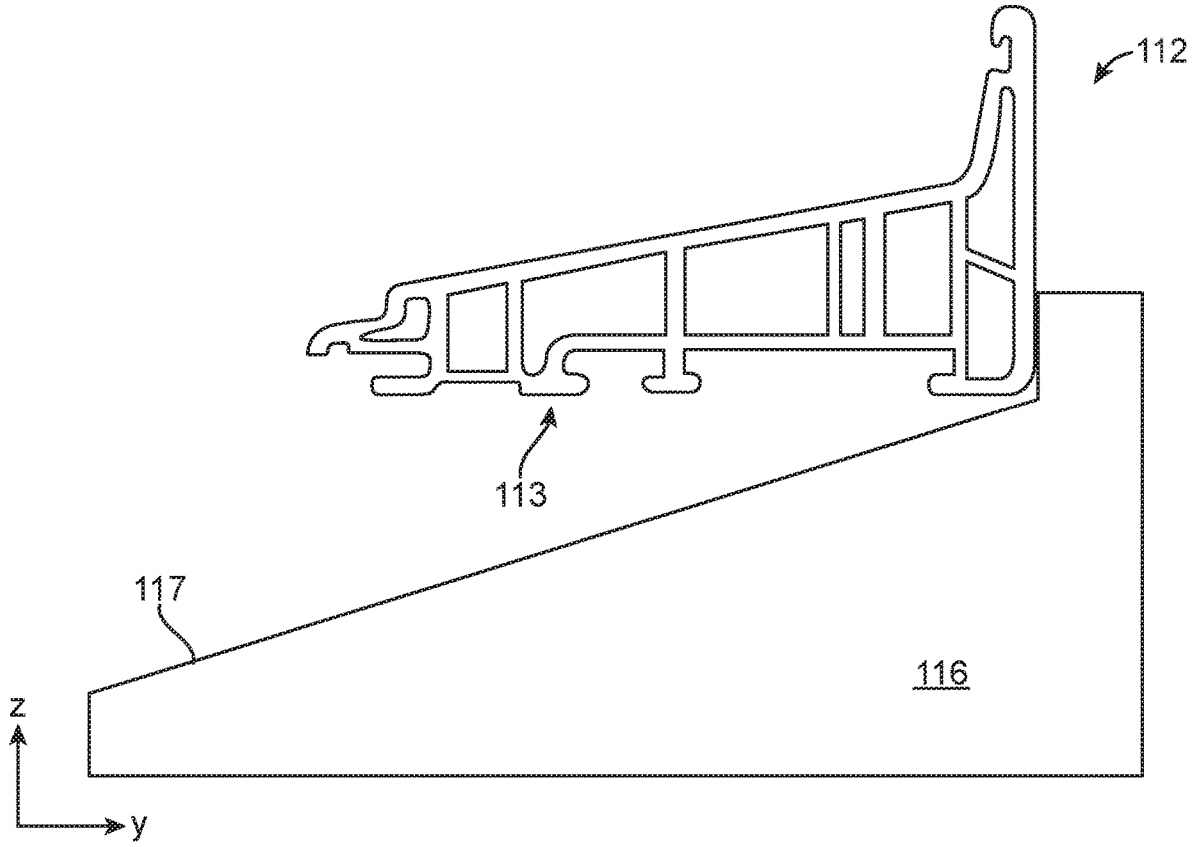
FIG. 6 is a cross-sectional view of one illustrative embodiment of the sill of a fenestration unit having a horizontal bottom positioned on an opening sill having an angled surface.
Figure 7:
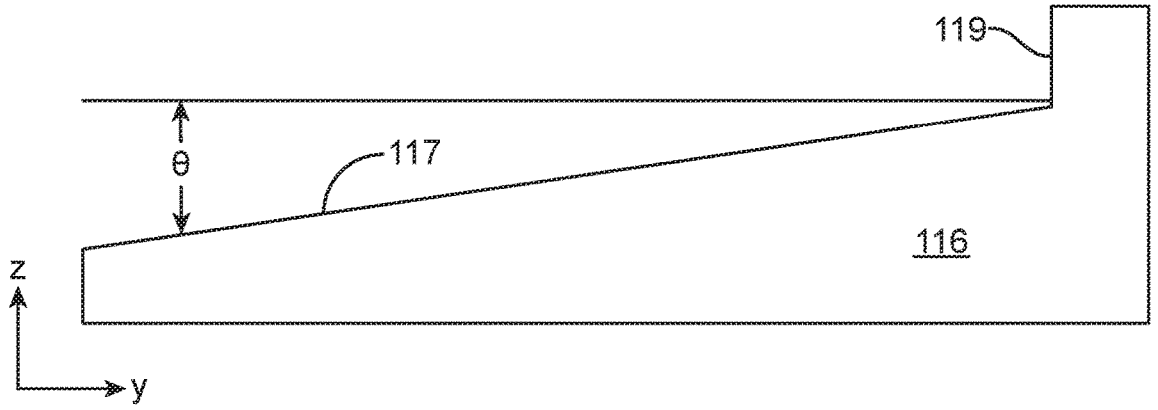
FIG. 7 is a cross-sectional view of the opening sill of FIG. 6 with a horizontal line positioned above the angled sill surface.

For example, FIG. 6 is a cross-sectional view of one illustrative embodiment of the sill 112 of a fenestration unit having a horizontal bottom 113 positioned on an opening sill 116 having an angled surface 117. The horizontal bottom 113 of the does not match the sloped or angled surface 117 of the opening sill 116 on which the fenestration unit sill 112 is positioned.

The installation process in a situation such as this may include, for example, measuring the angle of the slope or angled sill surface 117 relative to a horizontal axis. As seen in, e.g., FIG. 7, the angle θ (theta) represents the angle formed between the horizontal axis and the sloped or angled sill surface 117 (where the horizontal axis is aligned with the Y-axis in the depicted illustrative embodiment).

Figure 8:
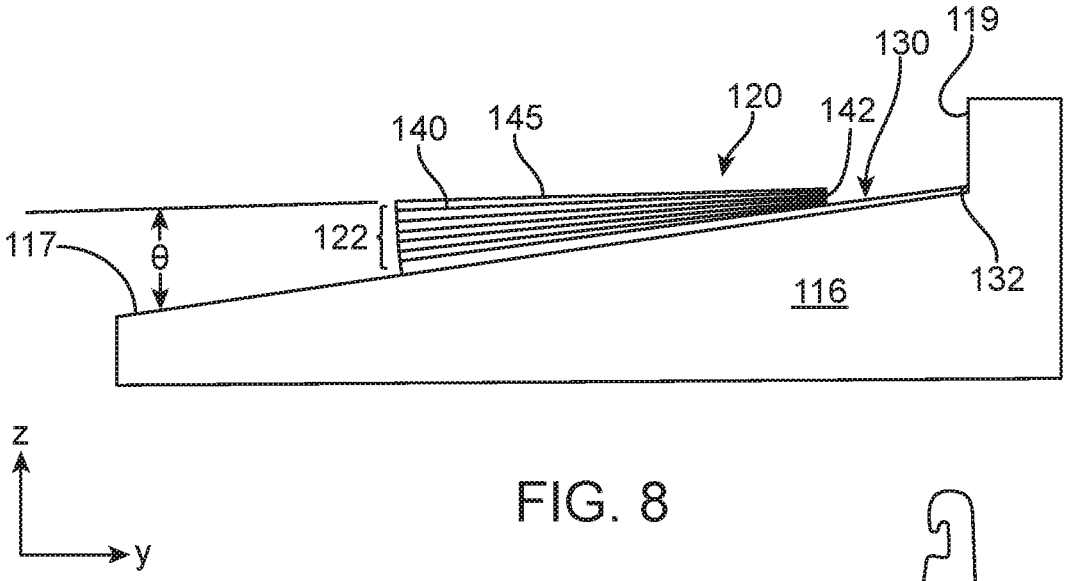
FIG. 8 is a cross-sectional view of the opening sill of FIG. 7 with one illustrative embodiment of an angled shim stack positioned thereon, wherein the angled shim stack provides a horizontal upper surface.

After determining the angle of the sill surface 117 relative to a horizontal axis, the illustrative embodiment of an angled shim stack 120 may be adjusted and positioned on the angled sill surface 117 as depicted in FIG. 8. In particular, the angled shim stack 120 may be adjusted to provide a wedge angle that matches the angle θ (theta) such that the top surface 145 of the uppermost shim 140 aligns with the horizontal axis. Adjustment of the angled shim stack 120 may include, for example, removal or addition of shims 140 to the stack of shims 122 provided on base shim 130. Furthermore, positioning of the angled shim stack may, in one or more embodiments, involve placing the leading edge 132 of base shim 130 against the stop 119 such that the angled shim stack 120 is properly located to support the sill of a fenestration unit.

Figure 9:
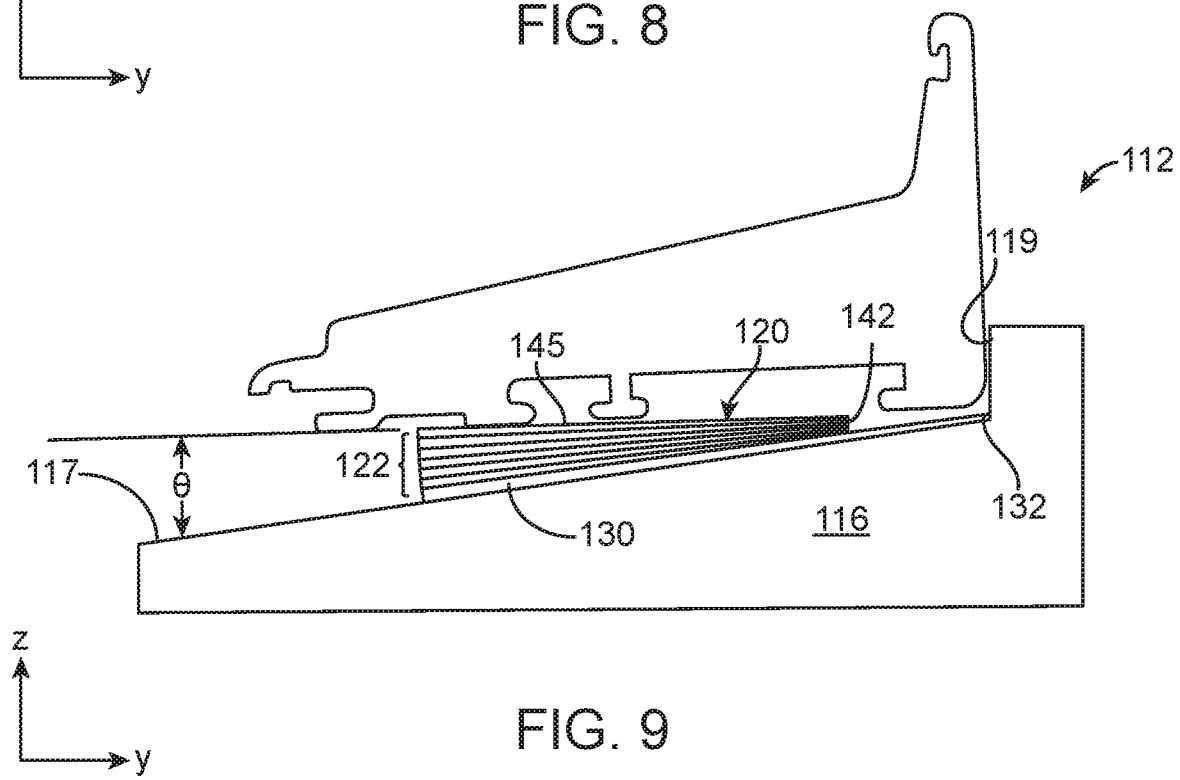
FIG. 9 is a cross-sectional view of FIG. 8 with the fenestration unit sill of FIG. 6 positioned on the upper surface of the angled shim stack.

In particular, FIG. 9 depicts the fenestration unit in position on the angled shim stack 120, with the angled shim stack providing support to the horizontal base surface of the sill 112. As discussed herein, the leading edges of the shims in the stack of shims may be set back from the leading edge of the base shim in one or more embodiments of an angled shim stack as described herein. One potential advantage of that setback that is illustrated in FIG. 9 is that stack of shims 122 do not change the height of the sill surface 117 where the sill surface 117 meets the stop 119. If the leading edges 142 of the stack of shims 122 were not set back from the leading edge 132 of the base shim, then the thickness of the shim stack 122 at the leading edges 142 of the shims may undesirably reduce the height of the opening into which the fenestration unit is being installed.

In one illustrative example, the angled shim stack 120 includes shims 140 and a base shim 130 (all of which have wedge angles of 1°). The angle θ (theta) by which the surface 117 of sill 116 deviates from horizontal is 8°. If, prior to adjustment, the angled shim stack 120 forms a wedge angle of 15°, i.e., includes a base shim 130 and 14 shims 140, then removal of seven shims 140 from the angled shim stack 120 provides an angled shim stack having a wedge angle of 8° such that the upper surface 145 of the uppermost shim 140 is substantially level with the horizontal axis and capable of providing support to the sill 112. If the angle θ (theta) by which the surface 117 of sill 116 deviates from horizontal was greater than 15°, then additional shims having wedge angles of 1° (or more) could be added to the angled shim stack 120 such that the angled shim stack 120 would occupy the entire gap tween the surface 117 and the bottom of sill 112.

Figure 10:
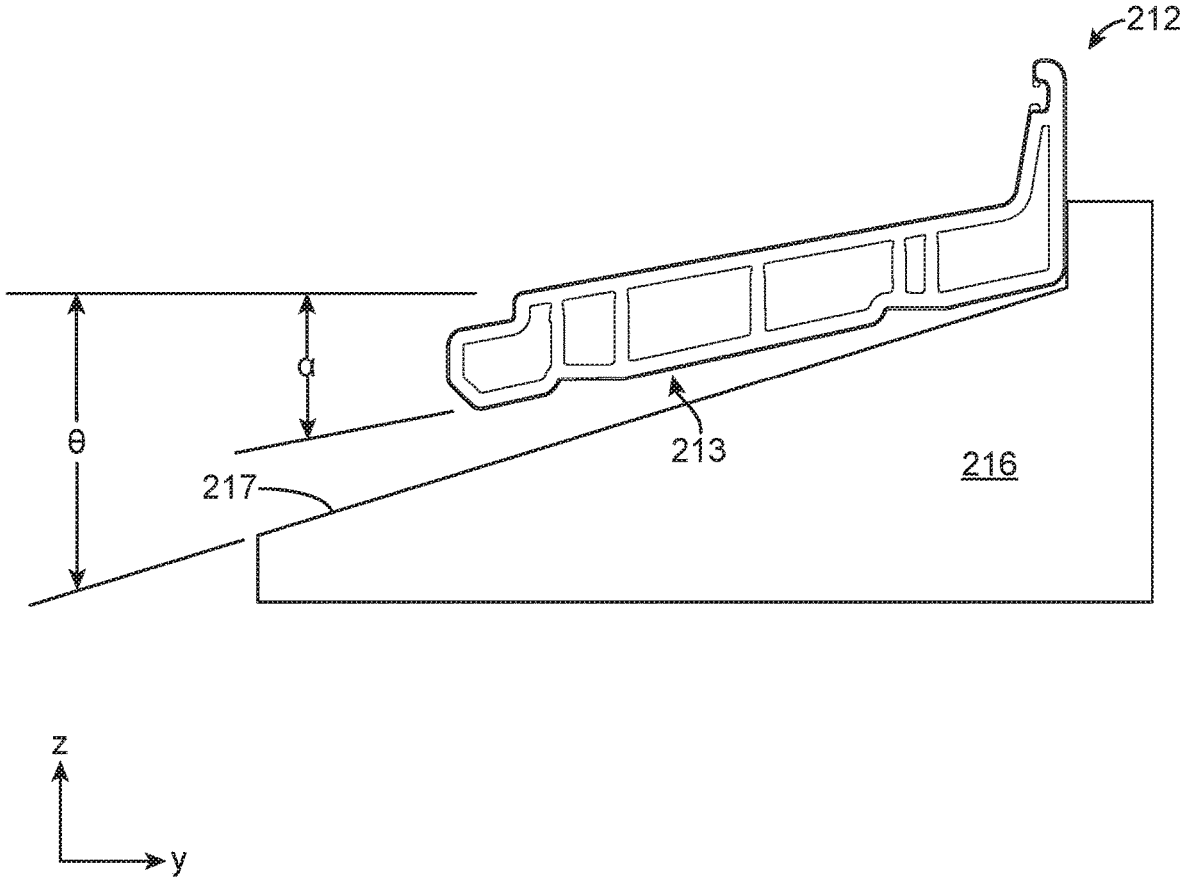
FIG. 10 is a cross-sectional view of another illustrative embodiment of a sill of a fenestration unit having a sloped or angled bottom that deviates from horizontal less than the angled surface of the opening sill on which the fenestration unit sill is located.

FIG. 10 is a cross-sectional view of another illustrative embodiment of a sill 212 of a fenestration unit having a sloped or angled bottom 213 that deviates from horizontal less than the angled surface 217 of the opening sill 216 on which the fenestration unit sill 212 is located. In particular, the angled bottom 213 of sill 212 forms an angle α (alpha) with a horizontal axis while the angled surface 217 of sill 216 forms an angle θ (theta) with the horizontal axis (where the horizontal axis is aligned with the Y-axis in the depicted illustrative embodiment).

Figure 11:
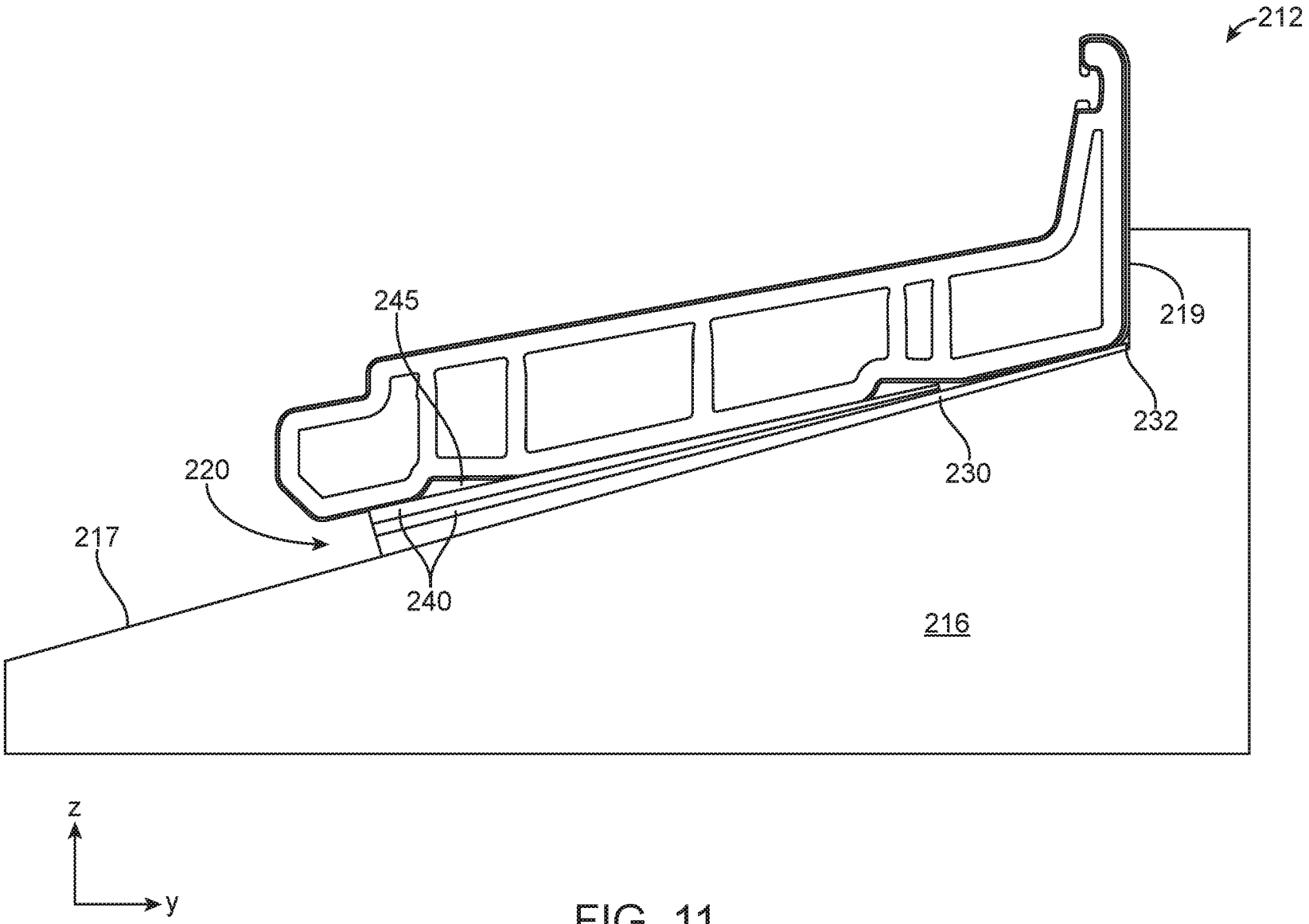
FIG. 11 is a cross-sectional view the opening sill of FIG. 10 with one illustrative embodiment of an angled shim stack positioned thereon, wherein the angled shim stack occupies a gap between the angled bottom sill of the fenestration unit and the opening sill.

FIG. 11 depicts one illustrative embodiment of an angled shim stack 220 positioned between the sill 212 and the angled surface 217, with the angled shim stack 220 occupying the gap between the angled bottom sill 212 of the fenestration unit and the angled surface 217 of the opening sill 216. Adjustment of the angled shim stack 220 to properly occupy the gap between the angled sill bottom 212 and the angled surface 217 may include, for example, removal or addition of shims 240 to the stack of shims provided on base shim 230.

In the depicted illustrative embodiment, the leading edge 232 of the base shim 230 of the angled shim stack 220 is positioned against the stop 219 at one end of the angled surface 217 of the with the base shim 230 extending away from the stop 219. Shims 240 of the angled shim stack 220 fill the remainder of the gap such that the top surface 245 of the uppermost shim 240 is positioned to support the bottom of the sill 212 above the angled surface 217 of sill 216.

In one illustrative example, the angled shim stack 220 may include shims 240 and a base shim 230 (all of which have wedge angles of 1°). The angle θ (theta) by which the surface 217 of sill 216 deviates from horizontal is 15° while the angle α (alpha) by which the bottom of the fenestration unit sill 212 deviates from horizontal is 12°. If, prior to adjustment, the angled shim stack 220 forms a wedge angle of 15°, i.e., includes a base shim 230 and 14 shims 240, then removal of twelve shims 240 from the angled shim stack 320 provides an angled shim stack having a wedge angle of 3° such that the upper surface 245 of the uppermost shim 240 is positioned to provide support to the angled bottom of sill 212.

While FIGS. 10-11 depict one embodiment in which the angled bottom surface of the sill 212 deviates from horizontal by an angle α (alpha) that is less than the angle θ (theta) by which the sloped surface 217 of sill 216 deviates from horizontal, this arrangement may not always be present when using a fenestration unit having an angled sill bottom.

Figure 12:
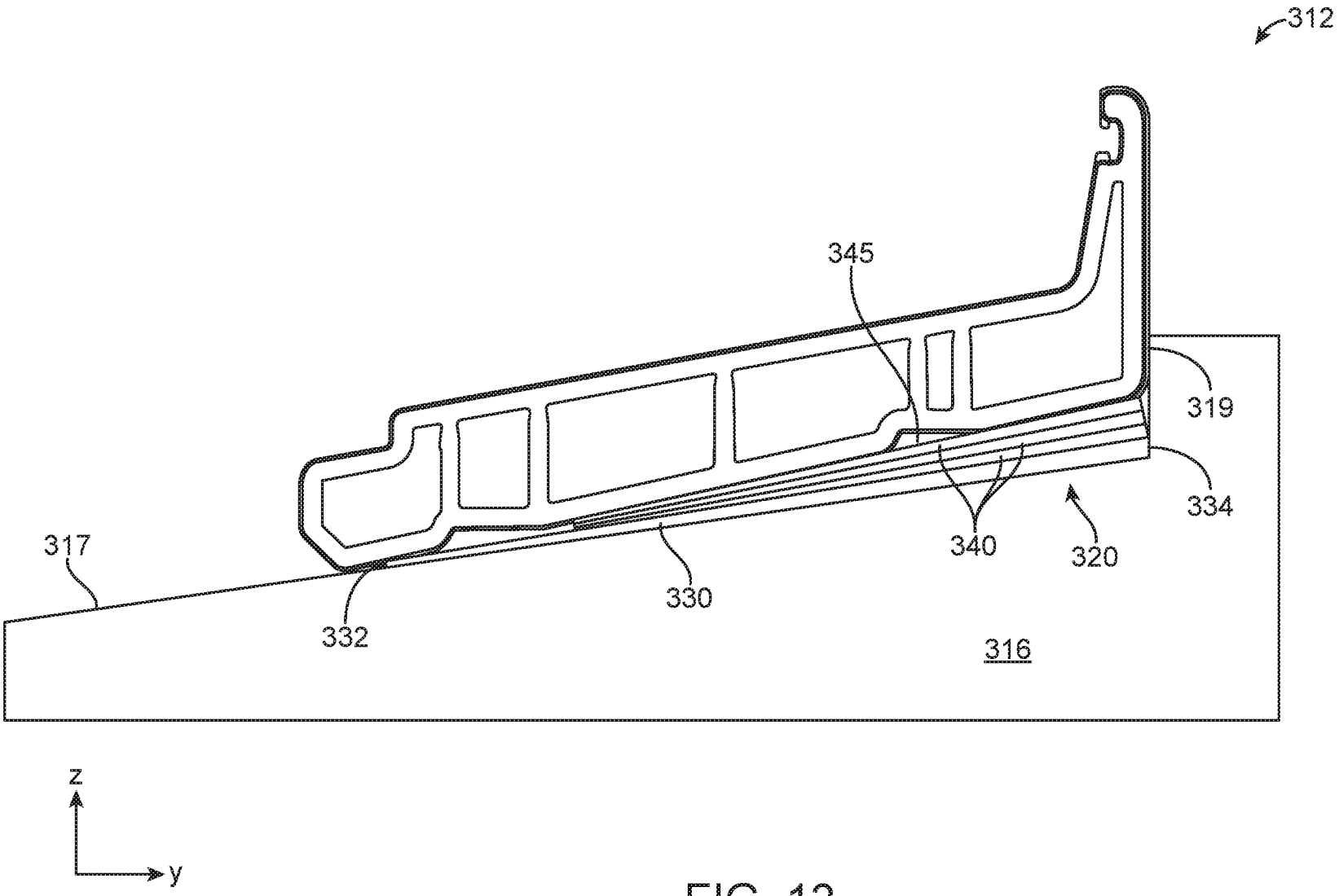
FIG. 12 is a cross-sectional view of another illustrative embodiment of a sill of a fenestration unit having a sloped or angled bottom that deviates from horizontal more than the angled surface of the opening sill on which the fenestration unit sill is located, with an angled shim stack occupying the gap between the angled bottom sill of the fenestration unit and the opening sill, wherein the angled shim stack is in a reverse orientation as compared to the angled shim stack of FIG. 11.

FIG. 12 is a cross-sectional view of one illustrative embodiment of a sill 312 of a fenestration unit having a sloped or angled bottom that deviates from horizontal more than the angled surface 317 of the opening sill 316 on which the fenestration unit sill 312 is located. In a situation such as that depicted in FIG. 12, and angled shim stack 320 may still be used to occupy the gap between the angled bottom sill 312 of the fenestration unit and the opening sill 316 to provide proper support to the sill 312. In such a situation, however, the angled shim stack 320 is positioned in a reverse orientation as compared to the angled shim stack 220 of FIG. 11. In particular, the trailing edges of the base shim 330 and shims 340 are positioned proximate the stop 319, while the leading edge 332 of the base shim 330 is located distal from the stop 319. Adjustment of the angled shim stack 320 to properly occupy the gap between the angled sill bottom 312 and the angled surface 317 may include, for example, removal or addition of shims 340 to the stack of shims provided on base shim 330 as described elsewhere herein.

Figure 13:
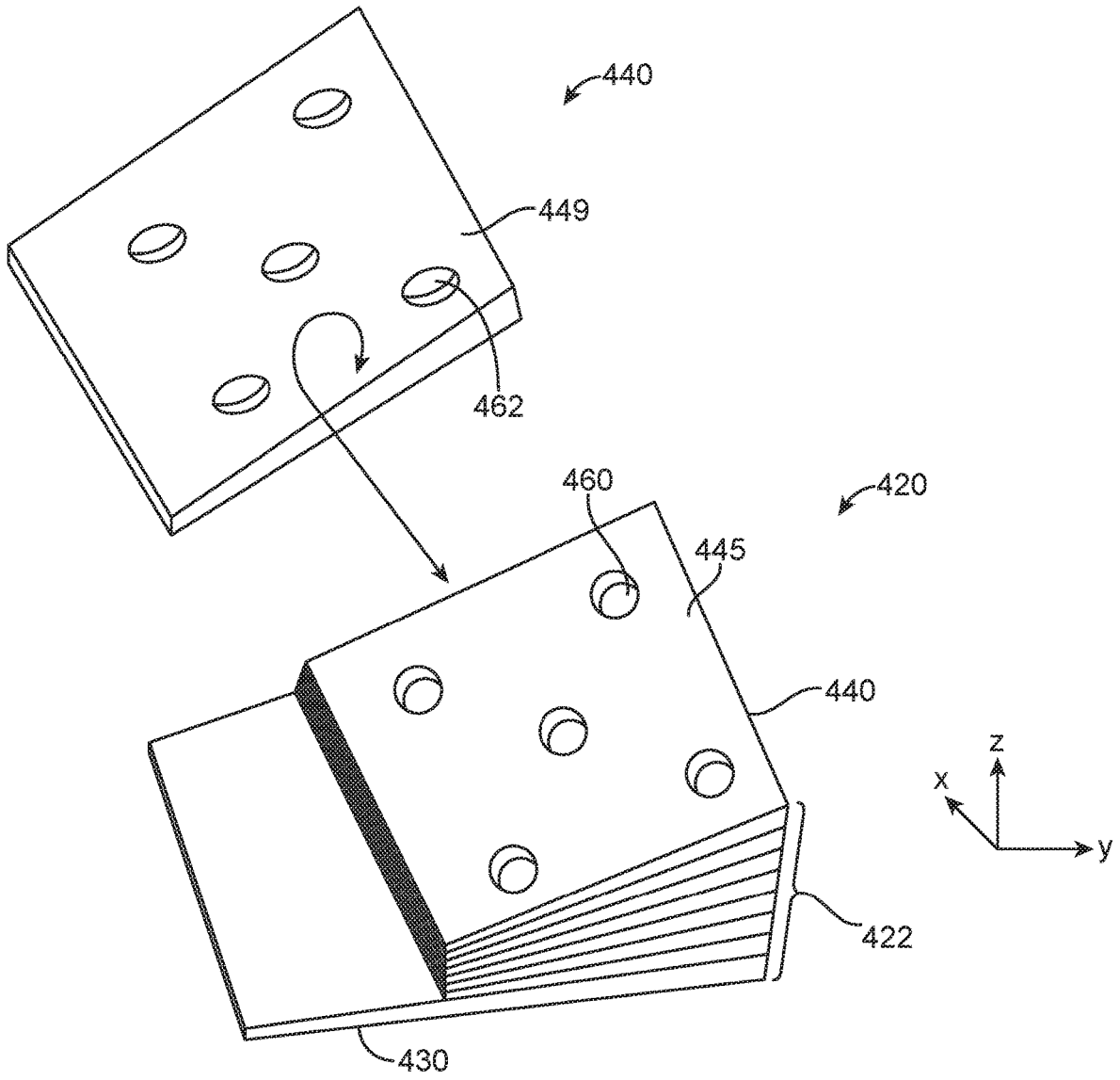
FIGS. 13-14 depict illustrative embodiments of shim stacks including shims fixedly attached to each other by a mechanical connection as described herein.

One illustrative embodiment of a shim stack 420 including shims 440 fixedly attached to each other by a mechanical connection is depicted in FIG. 13. The shim stack 420 includes a base shim 430 and a stack 422 of shims 440 positioned thereon. One of the shims 440 is depicted removed from the stack 422 and rotated such that its bottom surface 449 is seen in FIG. 13, while the top surface 445 of the underlying shim 440 attached to the stack 422 is also depicted. The mechanical connection formed between the shims 440 is, in the depicted embodiment, in the form of recesses 460 formed into top surface 445 of shim 440 and corresponding protrusions or posts 462 protruding from the bottom surface 449 of the removed shim 440. When assembled, the recesses 460 and protrusions/posts 462 form a mechanical connection that may involve a friction fit. In one or more alternative embodiments, the recesses 460 and protrusions/posts 462 may be in the form of mating interlocking structures. Although five pairs of recesses 460 and protrusions/posts 462 are depicted in the illustrative embodiment, it will be understood that any suitable number of connections may be provided between the shims 440 of the stack 422 as needed to fixedly attach the shims 440 to each other as described herein. In one or more embodiments, the recesses 460 and protrusions/posts 462 on the opposing top and bottom surfaces of a shim 440 may be aligned with each other in a manner similar to that described herein with respect to the fastener openings 48 depicted in FIGS. 5A-5B.

Figure 14:
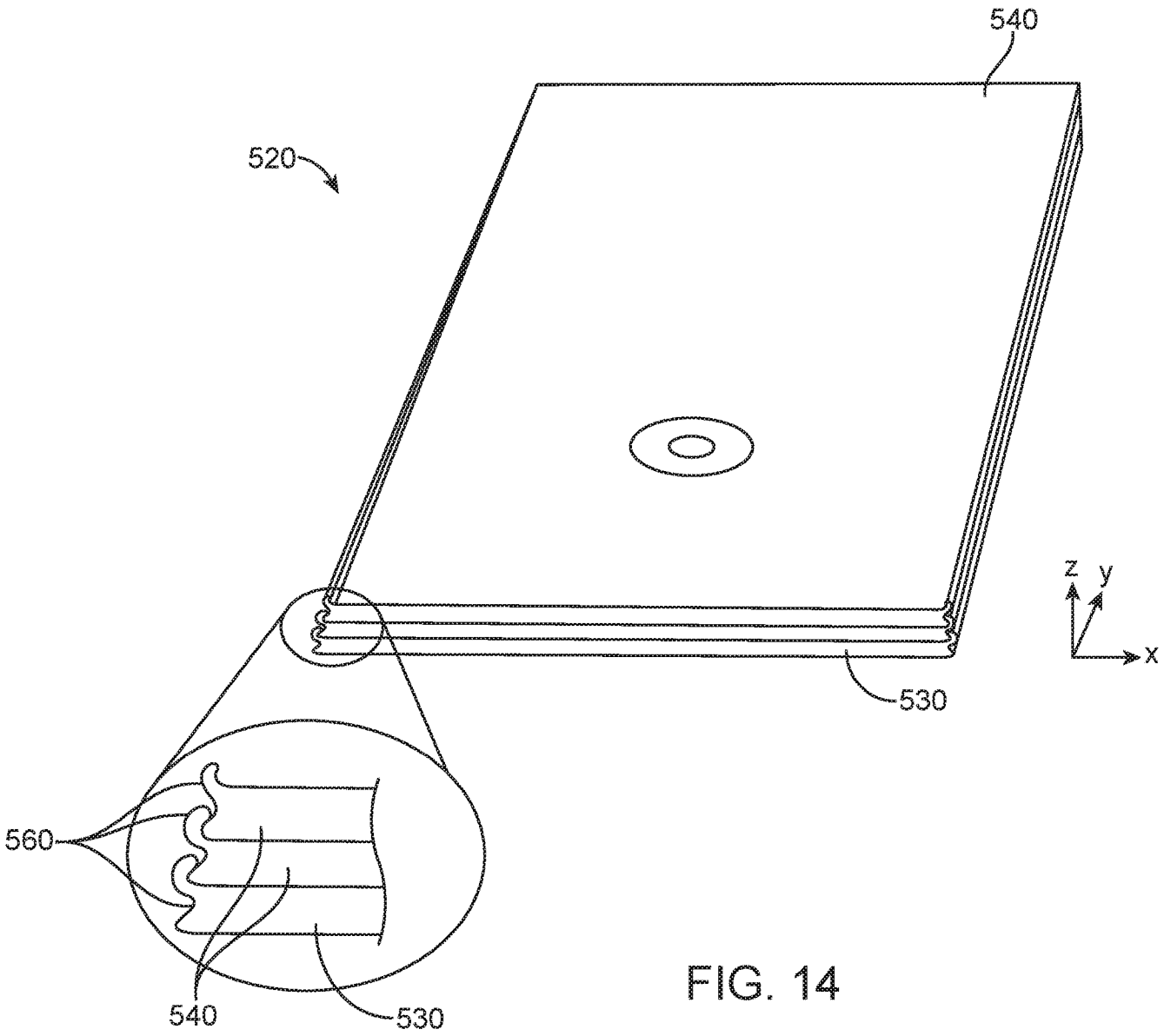

Another illustrative embodiment of a shim stack 520 in which the shims 540 and base shim 530 are fixedly attached to each other by another illustrative embodiment of a mechanical connection is depicted in FIG. 14. The shims 540 and the base shim 530 include structures 560 along their respective edges that form a mechanical connection through mating interlocking structures on the adjacent pairs of shims.

It should be understood that the illustrative embodiments of mechanical connections depicted in, e.g., FIGS. 13-14, are only two examples of different mechanical connections that may be used to fixedly attached pairs of adjacent shims to each other in one or more embodiments of shim stacks as described herein.

One or more embodiments of shim stacks as described herein may include interlocking structures configured to interlock one or more shims of a shim stack with the sill of a fenestration unit. In one or more embodiments, such interlocking structures may assist in proper positioning of a shim stack relative to a fenestration unit, provide more secure positioning of the shim stack relative to the fenestration unit after installation, etc.

Figure 15:
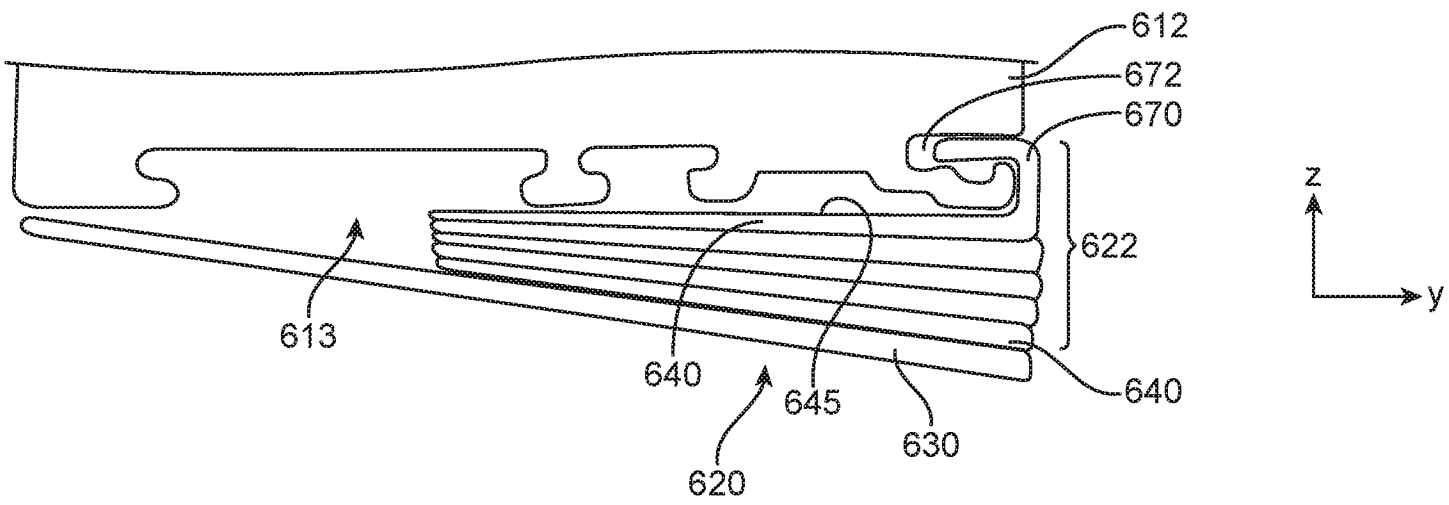
FIGS. 15-17 depict illustrative embodiments of shim stacks including a frame interlock structure as described herein.

One illustrative embodiment of a shim stack 620 including a frame interlock structure is depicted in FIG. 15. The shim stack 620 includes a base shim 630 and a stack 622 of shims 640 located on the base shim 630. Also depicted in FIG. 15 is a sill 612 of a fenestration unit. In particular, the sill 612 is depicted in a cross-sectional view. As depicted in FIG. 15, the sill 612 includes a shim interlock structure 672 that is complementary with a frame interlock structure 670 on the top surface 645 of the uppermost shim 640 of the shim stack 622. The frame interlock structure 670 fits within the cavity formed by the complementary shim interlock structure 672 on the fenestration frame member 612. In one or more embodiments, the frame interlock structure 670 and complementary shim interlock structure 672 may cooperate to limit over insertion of the shim stack 620 along the y-axis.

Figure 16:
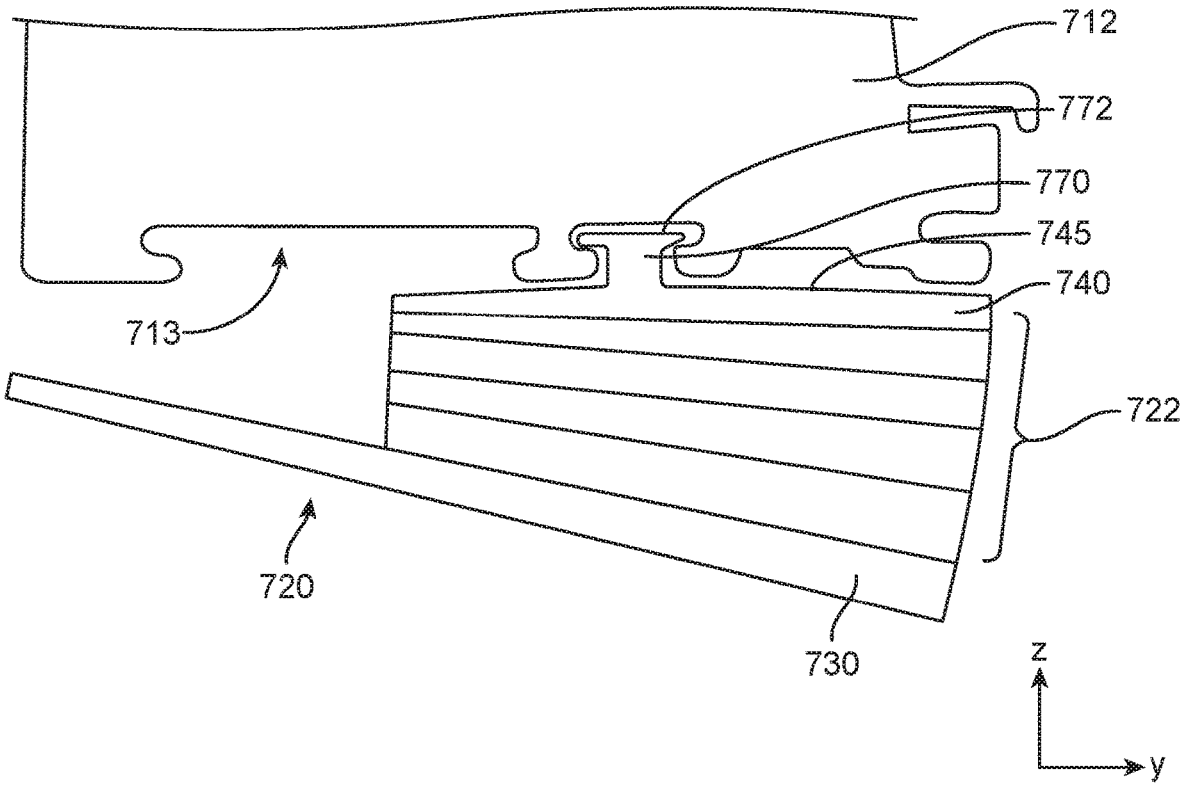

Another illustrative embodiment of a shim stack 720 including a frame interlock structure is depicted in FIG. 16. The shim stack 720 includes a base shim 730 and a stack 722 of shims 740 located on the base shim 730. Also depicted in FIG. 16 is a sill 712 of a fenestration unit. In particular, the bottom surface 713 of the sill 712 is depicted in a cross-sectional view. As depicted in FIG. 16, the sill 712 includes a shim interlock structure 772 that is complementary with a frame interlock structure 770 protruding from the top surface 745 of the uppermost shim 740 of the shim stack 722. The frame interlock structure 770 fits within a recess or cavity of the complementary shim interlock structure 772 on the fenestration frame member 712. In one or more embodiments, the frame interlock structure 770 and complementary shim interlock structure 772 may cooperate to properly position the shim stack 720 along the y-axis.

Figure 17:
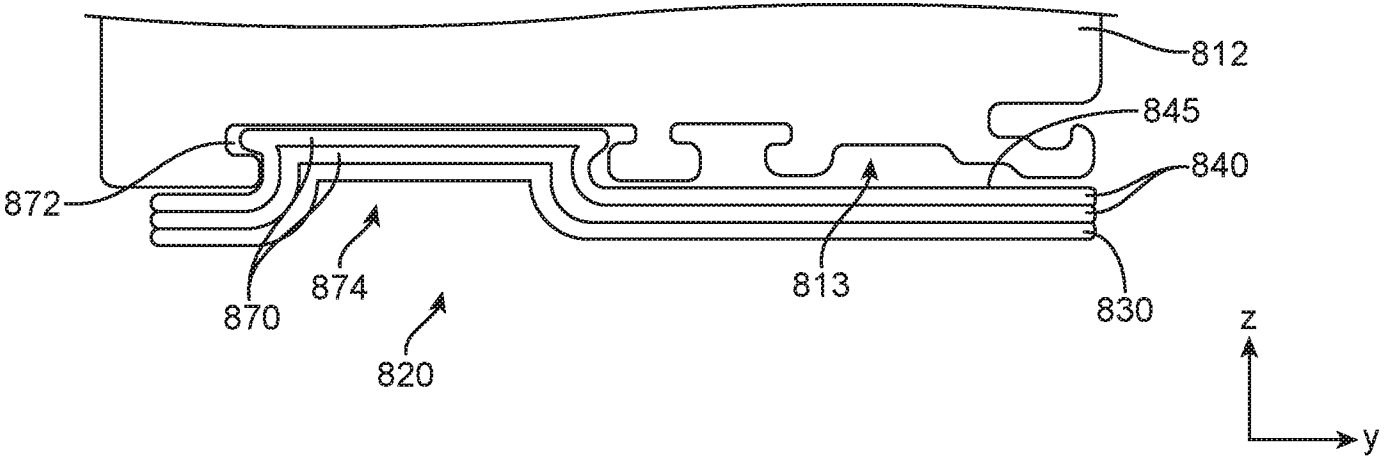

Another illustrative embodiment of a shim stack 820 including a frame interlock structure is depicted in FIG. 17. The shim stack 820 includes a base shim 830 and a stack of shims 840 located on the base shim 830. Also depicted in FIG. 17 is a sill 812 of a fenestration unit. In particular the sill 812 is depicted in a cross-sectional view. As depicted in FIG. 17, the sill 812 includes a shim interlock structure 872 formed in the bottom surface 813 of the sill 812 that is complementary with a frame interlock structure 870 on the top surface 845 of the uppermost shim 840. The frame interlock structure 870 fits within the cavity formed by the complementary shim interlock structure 872 on the fenestration frame member 812. In one or more embodiments, the frame interlock structure 870 and complementary shim interlock structure 872 may cooperate to fix the position of the shim stack 820 along the y-axis.

Another feature depicted in connection with the illustrative embodiment of shim stack 820 as seen in FIG. 17 is that multiple shims 840 of the shim stack 820 include a frame interlock structure 870 on their respective top surfaces such that removal of the uppermost shim 840 would expose the frame interlock structure of the underlying shim 840. In one or more embodiments, a system such as that depicted in FIG. 17 may be described as a nested set of frame interlock structures 870 in the shims 840. In one or more embodiments, the nested set of frame interlock structures 870 in the shims 840 may also serve to fixedly attached the pairs of adjacent shims 840 to each other as described herein.

Figure 18:
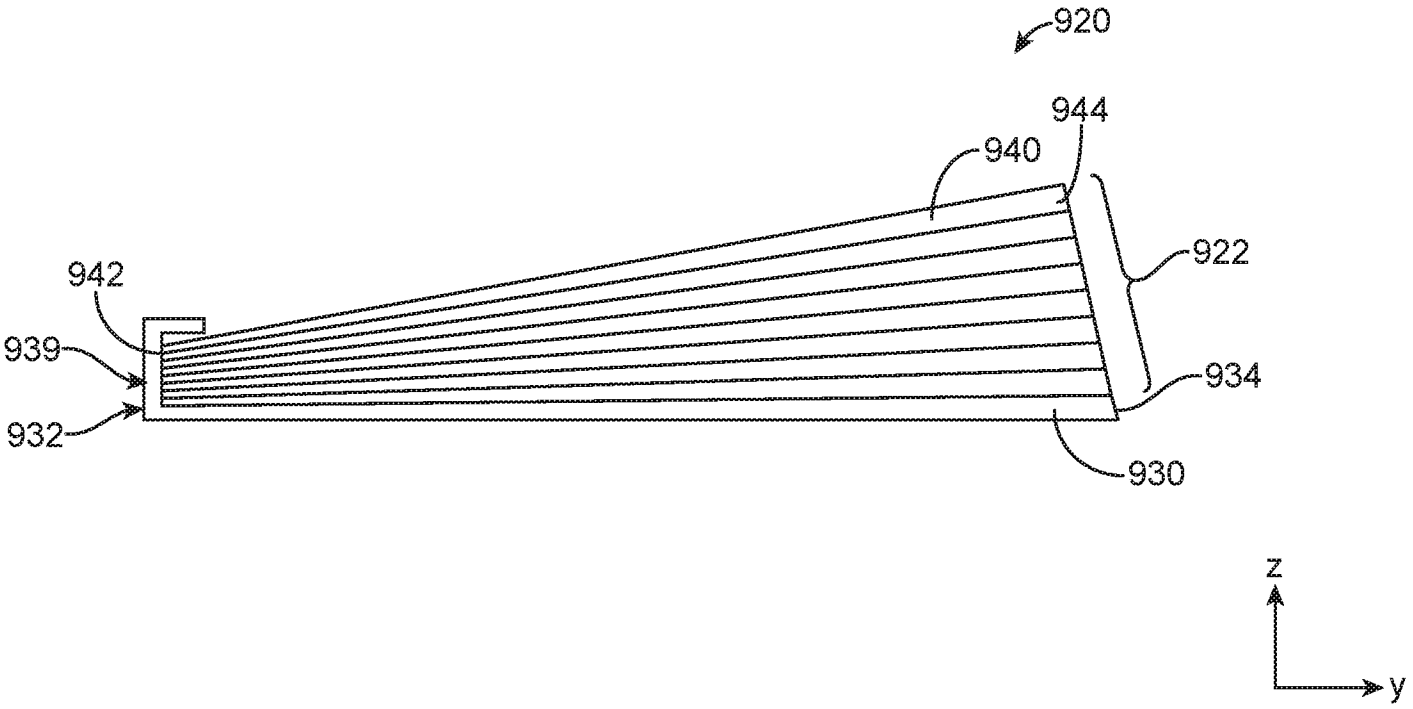
FIGS. 18-21 depict illustrative embodiments of shim stacks as described herein.

Another illustrative embodiment of a shim stack 920 is depicted in FIG. 18 where additional optional features of shim stacks as described herein are illustrated. In particular, the shim stack 920 includes a base shim 930 having a leading edge 932 and a trailing edge 934. A set 922 of shims 940 are provided on the base shim 932 formed the angled shim stack 920 depicted in FIG. 18. Each of the shims 940 includes a leading edge 942 and a trailing edge 944.

One variation depicted in FIG. 18 with respect to angled shim stack 920 is that the leading edges 942 of the shims 940 are, in essence, aligned with the leading edge 932 of the base shim 930. As a result, the leading shim edges 942 are not set back from the leading edge 932 of the base shim 930 by a setback distance as described in connection with other illustrative embodiments of the shim stacks described herein.

Another variation depicted in FIG. 18 with respect to angled shim stack 920 is that the base shim 930 includes a retention/alignment feature 939 proximate its leading edge 932 that may, in one or more embodiments, be configured to retain the shims 940 in position on the base shim 930 through, e.g., a compressive force or other attachment modality (e.g., adhesives, welding, friction fit, interlocking structures, etc. as described herein with respect to fixedly attaching shims to each other). In one or more alternatives, the feature 939 may serve merely to align the leading edges 942 of the shims 940 relative to the y-axis without serving any retention function with respect to the shims 940.

Figure 19:
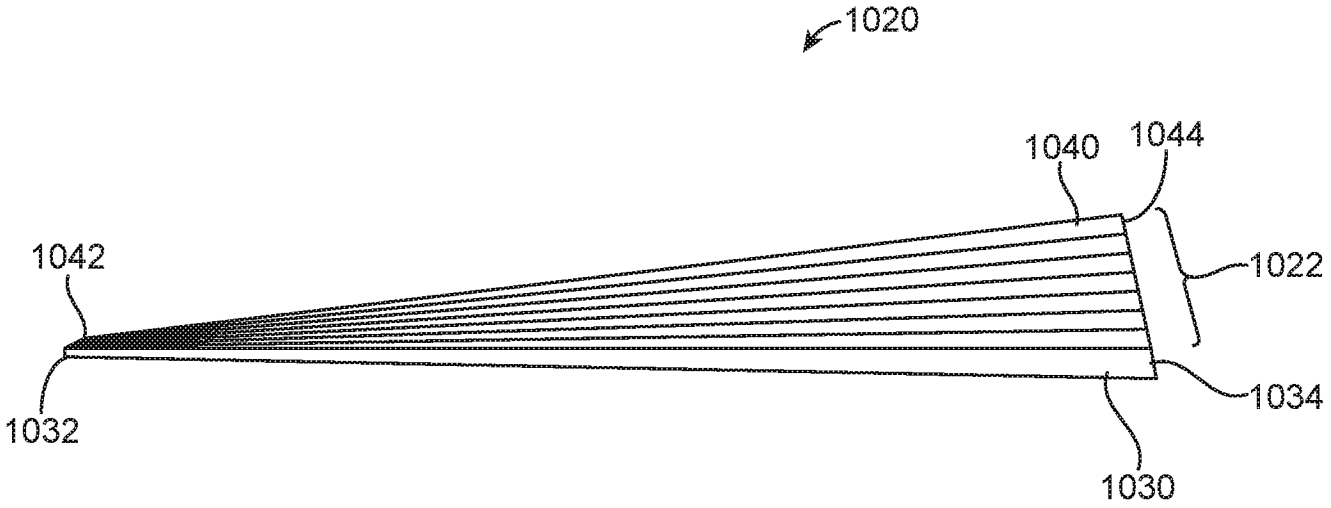

Still another alternative embodiment of a shim stack as described herein is depicted in FIG. 19 where a shim stack 1020 is depicted. The shim stack 1020 includes a base shim 1030 having a leading edge 1032 and a trailing edge 1034. A set 1022 of shims 1040 are provided on the base shim 1030, with each shim 1040 including a leading edge 1042 and a trailing edge 1044. One variation depicted in FIG. 19 with respect to angled shim stack 1020 is that the leading edges 1042 of the shims 1040 are, in essence, aligned with the leading edge 1032 of the base shim 1030. As a result, the leading shim edges 1042 are not set back from the leading edge 1032 of the base shim 1030 by a setback distance as described in connection with other illustrative embodiments of the shim stacks described herein.

Figure 20:
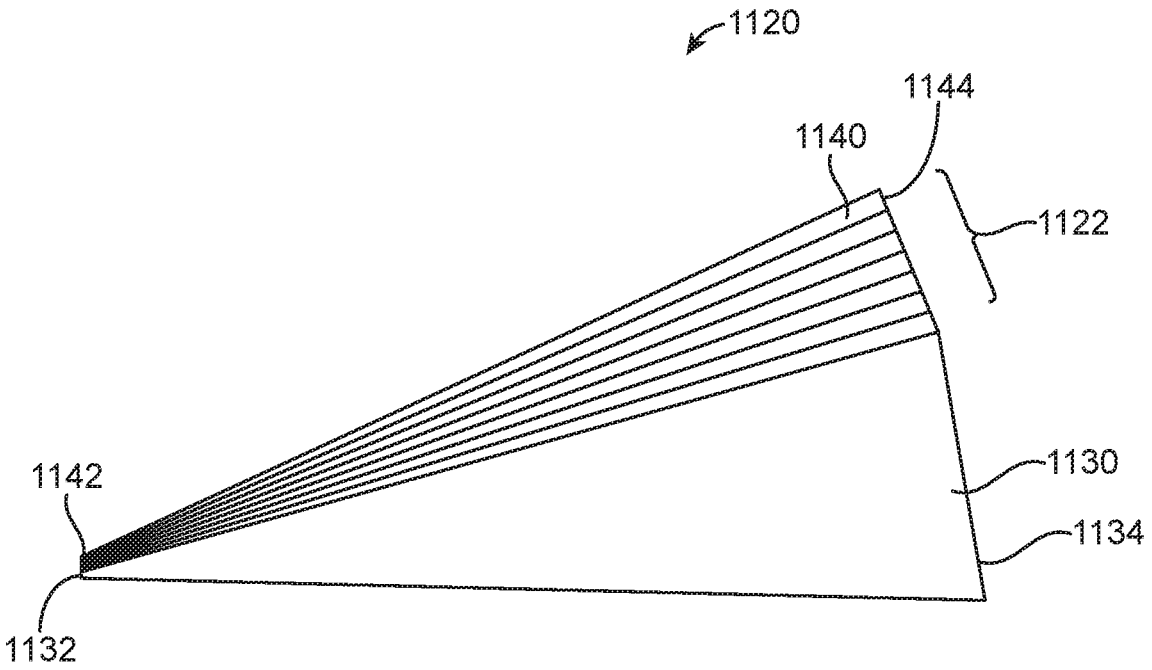

Another optional feature depicted in connection with the illustrative embodiment of FIG. 19 is that the base shim 1030 is of the same construction as the plurality of shims 1040 in the stack 1022 of shims 1040 attached to the base shim 1030. The base shim 1030 is, in embodiments such as the embodiment depicted in FIG. 19, identified as the base shim because it is positioned on the bottom of the angled shim stack 1020. Yet another alternative embodiment of a shim stack as described herein is depicted in FIG. 20 where a shim stack 1120 is depicted. The shim stack 1120 includes a base shim 1130 having a leading edge 1132 and a trailing edge 1134. A set 1122 of shims 1140 are provided on the base shim 1130, with each shim 1140 including a leading edge 1142 and a trailing edge 1144. In addition to having leading edges 1142 of shims 1140 in alignment with the leading edge 1132 of the base shim 1130, the depicted embodiment of shim stack 1120 includes a base shim 1130 that has a significantly larger wedge angle than the shims 1140 provided on the base shim 1130.

Figure 21:
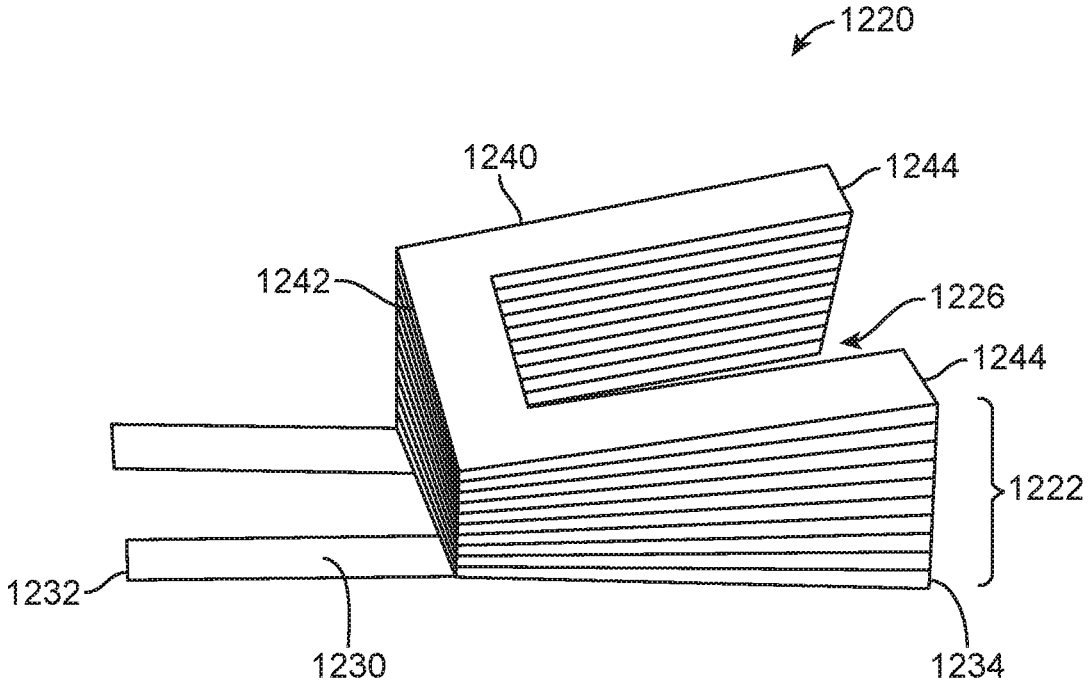

Still another illustrative embodiment of a shim stack as described herein is depicted in FIG. 21, where a shim stack 1220 is depicted. The shim stack 1220 includes a base shim 1230 having a leading edge 1232 and a trailing edge 1234. A set 1222 of shims 1240 are provided on the base shim 1230, with each shim 1240 including a leading edge 1242 and a trailing edge 1244. One variation in the depicted shim stack 1220 is that a notch 1226 is provided in the shims 1240 with the notch 1226 opening along the trailing edges 1244 of the shims 1240. This differs from the notch provided in the shims 40 of shim stack 20 as depicted in, e.g., FIGS. 3-4, where the notch provided in shims 40 faces in the opposite direction, i.e., towards the leading edges of both the shims 40 and the base shim 30. One potential advantage of providing a notch 1226 opening along the trailing edges 1244 of the shims 1240 is that foam and/or other sealants may be more readily received along the edge of a fenestration unit during installation. In such an embodiment, a notch may or may not be formed in the base shim 1230.

Although the leading and trailing edges of the base shims and shims stacked above the base shims are depicted as straight line edges, it should be understood that in one or more alternative embodiments of shim stacks described herein one or more of the leading and/or trailing edges of the base shims and shims forming the stack thereon may or may not have edges defined by a straight line. For example, the leading and/or trailing edges could be sinusoidal, sawtooth, stepped, etc. lines provided the leading and/or trailing edges serve their alignment function as needed.

The stacked shims and base shims of shim stacks used in connection with fenestration units as described herein may be constructed of any suitable material or combination of materials e.g., metal, wood, plastic, fiberglass, etc. further, the shims and base shims may be made of same or different materials within a single shim stack (e.g., the stacked shims could be made of one material while the base shim is made of a different material).

Further, although the various illustrative embodiments of shim stacks described herein include one or more wedge shaped shims such that the resulting shim stack forms and angled shim stack, one or more alternative embodiments of shim stacks that may fall within the present disclosure includes shim stacks in which none of the shims, i.e., the stacked shims and/or the base shim, form a wedge shape. As a result, such a shim stack would not form an angled shim stack as described herein. However, such shim stacks may incorporate one or more features of the illustrative angled shim stacks described herein such as, e.g., a setback distance between the leading edges of a base shim and the stacked shims located thereon, attachment of the stacked shims to each other (i.e., such that the shims are fixedly attached to each other as described herein), frame interlocking structures on one or more of the shims that are configured for use with complementary shim interlocking structures on a sill or other frame member of a fenestration unit as described herein, fastener openings, etc.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the angled shim stacks and related methods are discussed herein some possible variations have been described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. An angled shim stack comprising:

a base shim comprising a leading edge and a trailing edge, wherein the base shim comprises a base depth measured along a base depth axis extending between the leading edge and the trailing edge of the base shim, wherein the base shim comprises a bottom surface and a top surface opposite the bottom surface, wherein both the bottom surface and the top surface extend from the leading edge to the trailing edge of the base shim; and a plurality of shims attached to the base shim, wherein the plurality of shims form a stack of two or more shims positioned on the top surface of the base shim such that the top surface of the base shim is located between the stack of two or more shims and the bottom surface of the base shim and at least one shim of the stack of two or more shims is located between the base shim and at least one other shim of the stack of two or more shims, wherein each shim of the stack of two or more shims is fixedly attached to at least one adjacent shim of the stack of two or more shims and at least one shim of the stack of two or more shims is fixedly attached to the base shim, and wherein each shim of stack of two or more shims comprises:

a shim depth measured between a leading shim edge and a trailing shim edge along a shim depth axis aligned with the base depth axis;

a bottom shim surface and a top shim surface opposite the bottom shim surface, wherein both the bottom shim surface and the top shim surface extend from the leading shim edge to the trailing shim edge; and a thickness measured between the top shim surface and the bottom shim surface in a direction transverse to the shim depth axis increases when moving from the leading shim edge towards the trailing shim edge such that each shim of the stack of two or more shims defines a wedge shape;

wherein the angled shim stack defines a wedge angle measured between the bottom surface of the base shim and a top surface of an uppermost shim in the stack of shims, wherein removal of each shim of the stack of two or more shims reduces the wedge angle;

and wherein the leading shim edge of each shim of the stack of two or more shims is set back from the leading edge of the base shim;

and further wherein the leading shim edges of each shim of the stack of two or more shims are aligned with each other such that the leading edges of the shims of the stack of two or more shims are set back from the leading edge of the base shim by the same distance.

2. The angled shim stack of claim 1, wherein the trailing shim edge of at least one shim of the plurality of shims is aligned with the trailing edge of the base shim.

3. The angled shim stack of claim 1, wherein the trailing shim edge of at least one shim of the plurality of shims is closer to the trailing edge of the base shim than the leading shim edge is to the leading edge of the base shim.

4. The angled shim stack of claim 1, wherein each shim of the plurality of shims comprises a leading edge thickness measured between the top shim surface and the bottom shim surface in a direction transverse to the shim depth axis at the leading shim edge and a trailing edge thickness measured between the top shim surface and the bottom shim surface in a direction transverse to the shim depth axis at the trailing shim edge, wherein the trailing edge thicknesses of the plurality of shims are uniform.

5. The angled shim stack of claim 1, wherein each shim of the plurality of shims defines a selected wedge angle, wherein the selected wedge angle is defined by the increasing thickness of each shim of the plurality of shims as measured between the top shim surface and the bottom shim surface when moving from the leading edge to the trailing edge of each shim of the plurality of shims.

6. The angled shim stack of claim 5, wherein the selected wedge angle of two or more shims of the plurality of shims are different.

7. The angled shim stack of claim 1, wherein the plurality of shims comprises shims of two or more colors.

8. The angled shim stack of claim 1, wherein a thickness of the base shim measured between the top surface and the bottom surface in a direction transverse to the base depth axis increases when moving from the leading edge of the base shim towards the trailing edge of the base shim.

9. The angled shim stack of claim 1, wherein each shim of the plurality of shims comprises a fastener opening extending through the top and bottom shim surfaces, and wherein the fastener openings in the plurality of shims are aligned such that the fastener openings form a composite fastener opening extending through the stack of shims.

10. The angled shim stack of claim 1, wherein each pair of adjacent shims fixedly attached to each other are attached by a mechanical connection.

11. The angled shim stack of claim 1, wherein at least one shim of the plurality of shims comprises a frame interlock structure configured to interlock with a complementary shim interlock structure on a fenestration frame member.

12. The angled shim stack of claim 11, wherein each shim of the plurality of shims comprises a frame interlock structure configured to interlock with a complementary shim interlock structure on a fenestration frame member, and wherein the frame interlock structures on each pair of adjacent shims of the plurality of shims interlock to fixedly attach the pair of adjacent shims to each other.

13. An angled shim stack comprising:

a base shim comprising a leading edge and a trailing edge, wherein the base shim comprises a base depth measured along a base depth axis extending between the leading edge and the trailing edge of the base shim, wherein the base shim comprises a bottom surface and a top surface opposite the bottom surface, wherein both the bottom surface and the top surface extend from the leading edge to the trailing edge of the base shim; and a plurality of shims attached to the base shim, wherein the plurality of shims form a stack of two or more shims positioned on the top surface of the base shim such that the top surface of the base shim is located between stack of two or more shims and the bottom surface of the base shim and at least one shim of the stack of two or more shims is located between the base shim and at least one other shim of the stack of two or more shims, wherein each shim of stack of two or more shims is fixedly attached to at least one adjacent shim of stack of two or more shims and at least one shim of the stack of two or more shims is fixedly attached to the base shim, and wherein each shim of stack of two or more shims comprises:

a shim depth measured between a leading shim edge and a trailing shim edge along a shim depth axis aligned with the base depth axis;

a bottom shim surface and a top shim surface opposite the bottom shim surface, wherein both the bottom shim surface and the top shim surface extend from the leading shim edge to the trailing shim edge; and a thickness measured between the top shim surface and the bottom shim surface in a direction transverse to the shim depth axis increases when moving from the leading shim edge towards the trailing shim edge such that each shim of stack of two or more shims defines a wedge shape;

wherein the angled shim stack defines a wedge angle measured between the bottom surface of the base shim and a top surface of an uppermost shim in the stack of shims, wherein removal of each shim of stack of two or more shims reduces the wedge angle;

wherein the leading shim edge of each shim of stack of two or more shims is set back from the leading edge of the base shim;

and wherein the trailing edges of each shim of the stack of two or more shims are aligned with the trailing edge of the base shim.

14. The angled shim stack of claim 13, wherein the leading shim edges of at least two shims of stack of two or more shims are aligned with each other such that the leading edges of the stack of two or more shims are set back from the leading edge of the base shim by the same distance.

15. The angled shim stack of claim 13, wherein each shim of the plurality of shims comprises a leading edge thickness measured between the top shim surface and the bottom shim surface in a direction transverse to the shim depth axis at the leading shim edge and a trailing edge thickness measured between the top shim surface and the bottom shim surface in a direction transverse to the shim depth axis at the trailing shim edge, wherein the trailing edge thicknesses of the plurality of shims are uniform.

16. The angled shim stack of claim 13, wherein each shim of the plurality of shims defines a selected wedge angle, wherein the selected wedge angle is defined by the increasing thickness of each shim of the plurality of shims as measured between the top shim surface and the bottom shim surface when moving from the leading edge to the trailing edge of each shim of the plurality of shims.

17. The angled shim stack of claim 16, wherein the selected wedge angle of two or more shims of the plurality of shims are different.

18. The angled shim stack of claim 13, wherein the plurality of shims comprises shims of two or more colors.

19. The angled shim stack of claim 13, wherein a thickness of the base shim measured between the top surface and the bottom surface in a direction transverse to the base depth axis increases when moving from the leading edge of the base shim towards the trailing edge of the base shim.

20. The angled shim stack of claim 13, wherein each shim of the plurality of shims comprises a fastener opening extending through the top and bottom shim surfaces, and wherein the fastener openings in the plurality of shims are aligned such that the fastener openings form a composite fastener opening extending through the stack of shims.

21. The angled shim stack of claim 13, wherein each pair of adjacent shims fixedly attached to each other are attached by a mechanical connection.

* * * * *